US008671508B2

(12) United States Patent
Nagasaka et al.

(10) Patent No.: US 8,671,508 B2
(45) Date of Patent: Mar. 18, 2014

(54) DUST COLLECTOR

(75) Inventors: Hidenori Nagasaka, Anjo (JP); Takeshi Kamiya, Anjo (JP)

(73) Assignee: Makita Corporation, Anjo-shi (JP)

( * ) Notice: Subject to any disclaimer, the term of this patent is extended or adjusted under 35 U.S.C. 154(b) by 362 days.

(21) Appl. No.: 12/941,471

(22) Filed: Nov. 8, 2010

(65) Prior Publication Data

US 2011/0113587 A1 May 19, 2011

(30) Foreign Application Priority Data

Nov. 17, 2009 (JP) ..... 2009-262133
Jan. 8, 2010 (JP) ..... 2010-003152
May 27, 2010 (JP) ..... 2010-121778

(51) Int. Cl.
*A47L 9/00* (2006.01)

(52) U.S. Cl.
USPC ..... 15/327.5; 15/327.2; 15/330; 15/339

(58) Field of Classification Search
USPC ..... 15/327.2, 327.5, 330, 339
See application file for complete search history.

(56) References Cited

U.S. PATENT DOCUMENTS

| | | | | |
|---|---|---|---|---|
| 2,024,367 | A | 12/1935 | Eriksson-Jons | |
| 4,223,419 | A | 9/1980 | Sato et al. | |
| 4,644,606 | A * | 2/1987 | Luerken et al. | 15/330 |
| 5,245,726 | A * | 9/1993 | Rote et al. | 15/339 |
| 5,440,781 | A * | 8/1995 | Kitazawa et al. | 15/344 |
| 6,324,720 | B1 * | 12/2001 | Beckey et al. | 15/326 |
| 7,526,833 | B2 * | 5/2009 | Cochran et al. | 15/327.2 |
| 7,870,640 | B2 * | 1/2011 | Hinklin et al. | 15/330 |
| 2003/0233730 | A1 | 12/2003 | Sanders et al. | |
| 2004/0088817 | A1 * | 5/2004 | Cochran et al. | 15/327.5 |
| 2008/0148513 | A1 | 6/2008 | Shaffer | |
| 2009/0241285 | A1 | 10/2009 | Hinklin et al. | |

FOREIGN PATENT DOCUMENTS

| | | |
|---|---|---|
| JP | A-62-290428 | 12/1987 |
| JP | A-63-230132 | 9/1988 |
| JP | A-10-127534 | 5/1998 |
| JP | A-2002-011662 | 1/2002 |
| JP | A-2004-160235 | 6/2004 |
| JP | A-2005-034175 | 2/2005 |
| JP | A-2009-091719 | 4/2009 |
| WO | WO 2009/114867 A1 | 9/2009 |

OTHER PUBLICATIONS

European Search Report dated Feb. 18, 2011 in corresponding European Patent Application No. 10191020.6.
Nov. 22, 2012 Office Action issued in Chinese Patent Application No. 201010549728.1.
Sep. 3, 2103 Office Action issued in Japanese Application No. 2010-003152 (with English translation).

* cited by examiner

*Primary Examiner* — Lee D Wilson
*Assistant Examiner* — Shantese McDonald
(74) *Attorney, Agent, or Firm* — Oliff PLC

(57) ABSTRACT

In a dust collector, a main body includes a motor and a rotary fan. The rotary fan is to be driven by the motor to suck air from outside through an intake port provided at the main body. A receptacle unit configured to allow a battery pack to be attached thereto and an exhaust port configured to allow a dust bag to be detachably attached thereto are provided at the main body. A handle capable of being grasped and a belt fastening part configured to allow a belt to be fastened thereto are also provided at the main body. At an underside of the main body, a supporting surface is provided which is configured to allow the dust collector with the dust bag and the battery pack attached to the exhaust port and to the receptacle unit respectively to be placed thereon.

19 Claims, 24 Drawing Sheets

DUST COLLECTOR

BACKGROUND OF THE INVENTION

This application claims the entire benefit of Japanese Patent Application Number 2009-262133 filed on Nov. 17, 2009, 2010-3152 filed on Jan. 8, 2010, and 2010-121778 filed on May 27, 2010, the entirety of which is incorporated by reference.

TECHNICAL FIELD

This invention relates to a dust collector which can also be used as a blower.

BACKGROUND ART

A dust collector, for example, as disclosed in JP 2004-160235 A (corresponding US Patent Application published under US 2004/0088817 A1) comprises a main body in which a motor and a rotary fan to be driven by the motor are included. At the main body of the dust collector, an intake port, a filter and an exhaust port are provided. Outside air is sucked through a hose attached to the intake port, and released through the exhaust port, so that dust or the like sucked together with the outside air can be caught and thus collected by the filter. In the dust collector, a battery as a source of electric power is incorporated and a handle and a belt fastening part are provided at a housing of the dust collector so as to render the dust collector convenient to carry.

Among various dust collectors known in the art is a dust collector of a specific type which can be carried with a hose or a nozzle, etc. attached to the exhaust port and thus can be used as a blower.

However, the aforementioned dust collector configured to have a filter included therein and collect dust within the housing should inevitably be large in size and heavy in weight as a whole. This would impair the handleability of the dust collector being carried and operated by an operator, impose a heavy burden on the operator particularly when it is used for a long time, and thus lower the work efficiency.

Thus, there is a need to provide a dust collector which can be used as a stationary dust collector to be operated in place and as a blower to be operated while being carried by an operator, and particularly which can be carried and operated by the operator with improved work efficiency.

The present invention has been made in an attempt to eliminate the above disadvantages, and illustrative, non-limiting embodiments of the present invention may overcome the above disadvantages and other disadvantages not described above.

SUMMARY OF INVENTION (1) In one aspect of the present invention, a dust collector is provided which comprises:

- a main body including a motor and a rotary fan to be driven by the motor;
- an intake port provided at the main body to suck air therethrough from outside into the main body by rotation of the rotary fan;
- an exhaust port provided at the main body to release the sucked air therethrough to the outside, and configured to allow a dust bag to be detachably attached thereto;
- a receptacle unit provided at the main body and configured to allow a battery pack as a source of electric power to be attached thereto;

- a handle provided at the main body and capable of being grasped;
- a belt fastening part provided at the main body and configured to allow a belt to be fastened thereto; and
- a supporting surface provided at an underside of the main body and configured to allow the dust collector with the dust bag and the battery pack attached to the exhaust port and to the receptacle unit respectively to be placed thereon.

(2) In the configuration described above in (1), the main body may include a housing that is an assembly composed of at least two divisional housings, across which the battery pack attached to the receptacle unit is located.

(3) In the configurations described above in (1) and (2), the dust collector may be configured such that the handle is provided at an upper portion of the main body, and the exhaust port and the receptacle unit are provided at opposite sides of the main body whereby the battery pack attached to the receptacle unit and the dust bag attached to the exhaust port are located oppositely to laterally sandwich the main body as viewed from a front side of the main body.

(4) In the configuration described above in (3), the handle may be configured to extend laterally as viewed from the front side of the main body in a direction along which the dust bag attached to the exhaust port and the battery pack attached to the receptacle unit are arranged.

(5) In the configurations described above in (1)-(4), the receptacle unit may be configured to allow the battery pack to be slid therealong from above the main body and thereby combined with the receptacle unit.

(6) In the configurations described above in (1)-(5), the exhaust port may be configured to orient downward.

(7) In the configurations described above in (1)-(6), the dust collector may be configured such that a center of gravity of the battery pack attached to the receptacle unit is in a position lower than that of a center of gravity of the main body having no battery pack attached to the receptacle unit.

(8) In the configuration described above in (7), the receptacle unit may be disposed at the underside of the main body to allow the battery pack to be attached to the underside of the main body.

The following advantageous effects may be expected by implementing the present invention in such a way as described above.

According to the configuration as described in (1), two modes of operation which an operator may select become available, which includes a portable use mode in which the main body is carried using a handle or a belt, and a stationary use mode in which the main body is set in place on a floor or the like. In particular, since the dust bag is provided externally without the need to provide a dust-collecting space within the main body, the main body can be designed to be compact in size and light in weight with an improved handleability during operation in the portable use mode, which thus increases the work efficiency.

According to the additional feature as described in (2), further advantage may be obtained in addition to that of (1); that is, the battery pack can be attached with a proper balance attained, and thus, improvements in stability can be expected and the terminals can be connected with increased ease.

According to the additional feature as described in (3), further advantage may be obtained in addition to that of (1) or (2); that is, since the dust bag and the battery pack is separately arranged laterally with respect to the main body, a proper balance can be attained during operation in the portable use mode, and thus the handleability can be improved.

According to the additional feature as described in (4), further advantage may be obtained in addition to that of (3); that is, for example, when an operator grasps the handle at his/her body side, the dust collector naturally becomes oriented with the dust bag and the battery pack arranged in the front-rear direction, and thus the operation in the portable use mode can probably be performed without being interfered with by the dust bag and the battery pack.

According to the additional feature as described in (5), further advantage may be obtained in addition to that of (1), (2), (3) or (4); that is, combining the battery pack with the receptacle unit from above the main body by sliding the battery pack along the receptacle unit makes it easy to attach and detach the battery pack to and from the receptacle unit before and after the operation in the stationary use mode, and the risk of accidental drop of the battery pack from the receptacle unit can be avoided.

According to the additional feature as described in (6), further advantage may be obtained in addition to that of (1), (2), (3), (4) or (5); that is, the downward-orienting exhaust port configuration serves to prevent the backflow of dust or the like within the exhaust port, and thus ensures that the dust or the like will be collected into the dust bag without fail. Moreover, the boss for a screw which may be provided above the exhaust port may be formed without protruding upward, and thus an uncalled-for protrusion from the main body can be reduced or removed so that the usability of the dust collector can be improved. Furthermore, when the dust collector is used as a blower, air blown therefrom is naturally oriented downward, and thus the usability of the dust collector as a blower can be improved.

According to the additional feature as described in (7), further advantage may be obtained in addition to that of (1), (2), (3), (4), (5) or (6); that is, with this specific configuration of the position of the center of gravity of the battery pack attached, the stability of the dust collector can be improved furthermore.

According to the additional feature as described in (8), further advantage may be obtained in addition to that of (7); that is, the position of the center of gravity of the dust collector with the battery pack attached is lower and thus the stability can be improved. Moreover, the dust collector may be designed to have the battery pack without protruding to the front, rear, left and right, thus can be compact in shape as viewed from above. This may make the operation of the dust collector in the portable use mode and the carrying of the dust collector easy and convenient.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DESCRIPTION OF EMBODIMENTS

Exemplary embodiments of the present invention will be described hereinafter with reference to the accompanying drawings.

General Setup of Dust Collector

Figure 1:
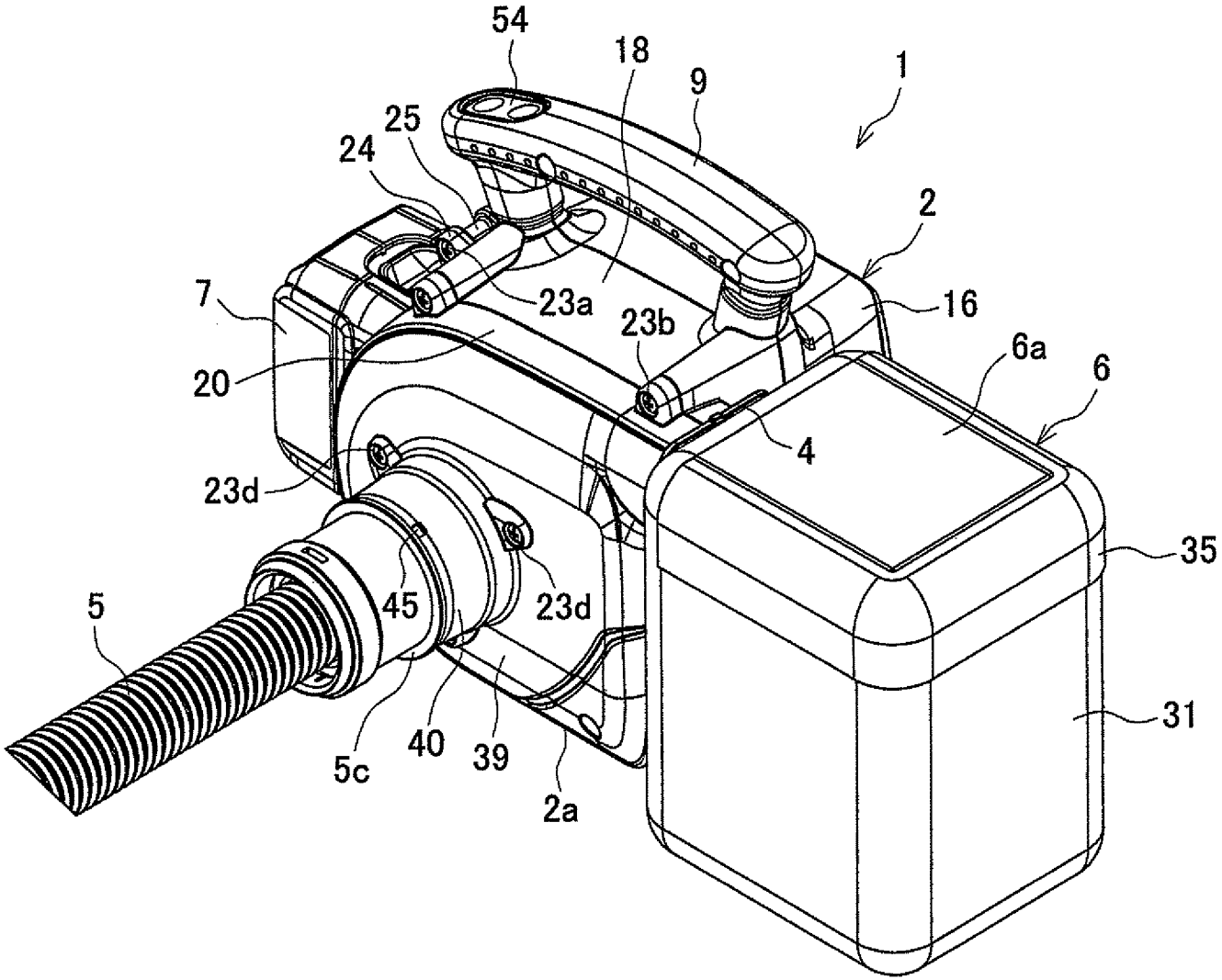
FIG. 1 is a perspective view of a dust collector according to an exemplary embodiment of the present invention.
Figure 2:
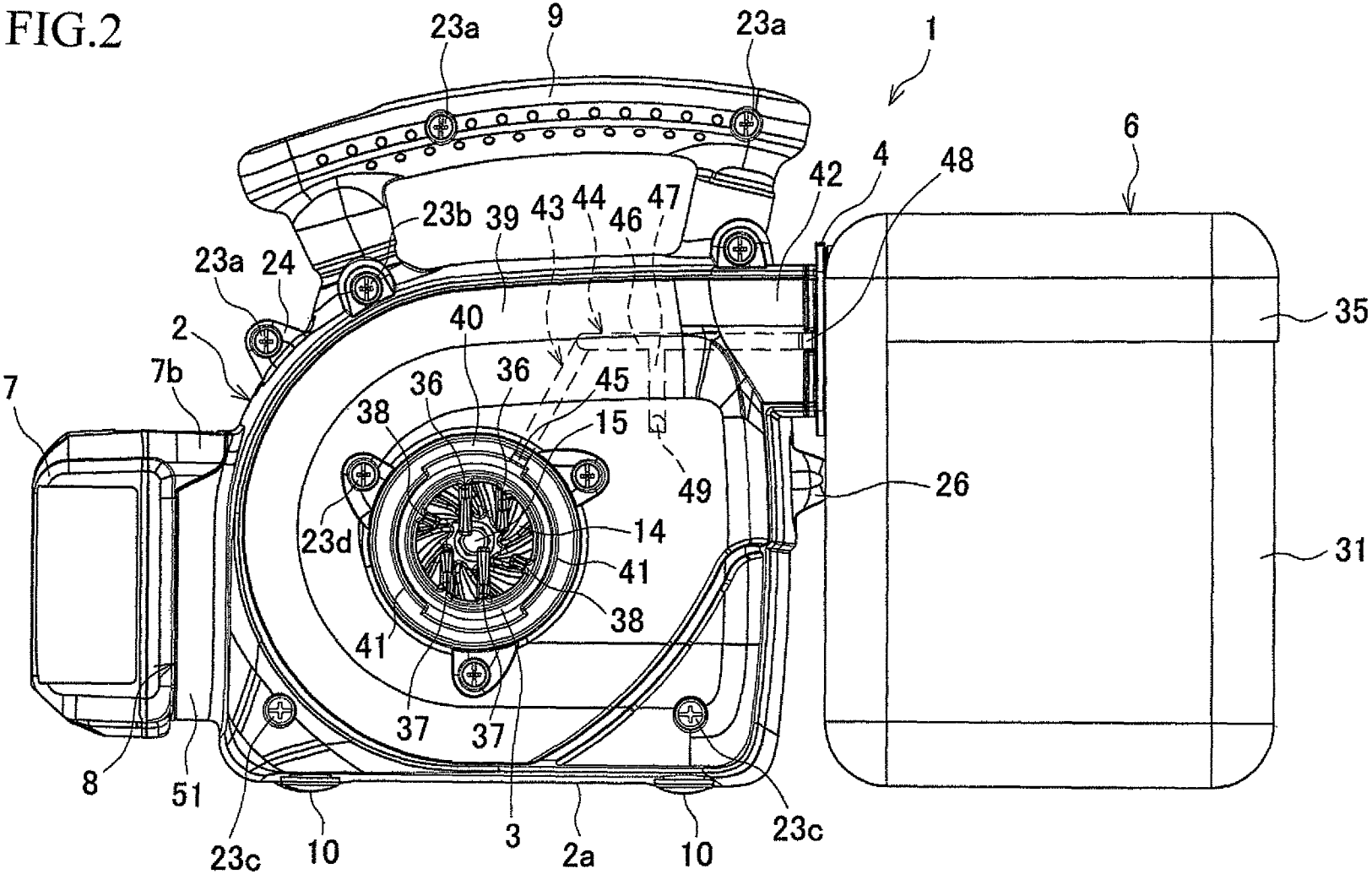
FIG. 2 is a front view of the dust collector.

Referring now to FIGS. 1 and 2, a dust collector 1 principally includes a generally rectangular parallelepiped main body 2 which incorporates a motor and a fan. An intake port 3 and an exhaust port 4 are provided at a front side and at an upper portion of a right side, respectively, of the main body 2. A hose 5 and a dust bag 6 are detachably attached to the intake port 3 and the exhaust port 4, respectively. Denoted by 7 is a battery pack as a source of electric power which is detachably attached to a receptacle unit 8 provided at a left side of the main body 2. That is, in this embodiment, three prime constituents are arranged such that the main body 2 is located between the dust bag 6 at the right and the battery pack 7 at the left which are thus symmetric with respect to the main body 2.

Figure 3A:
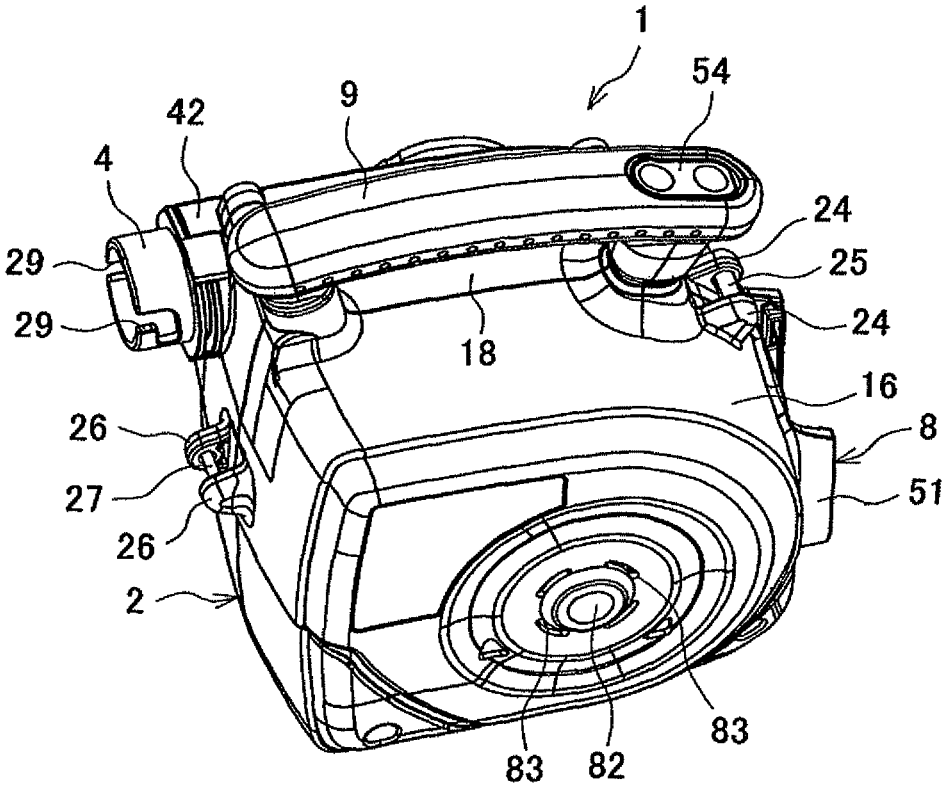
FIG. 3A is a perspective view of a main body of the dust collector as viewed from a rear side.
Figure 3B:
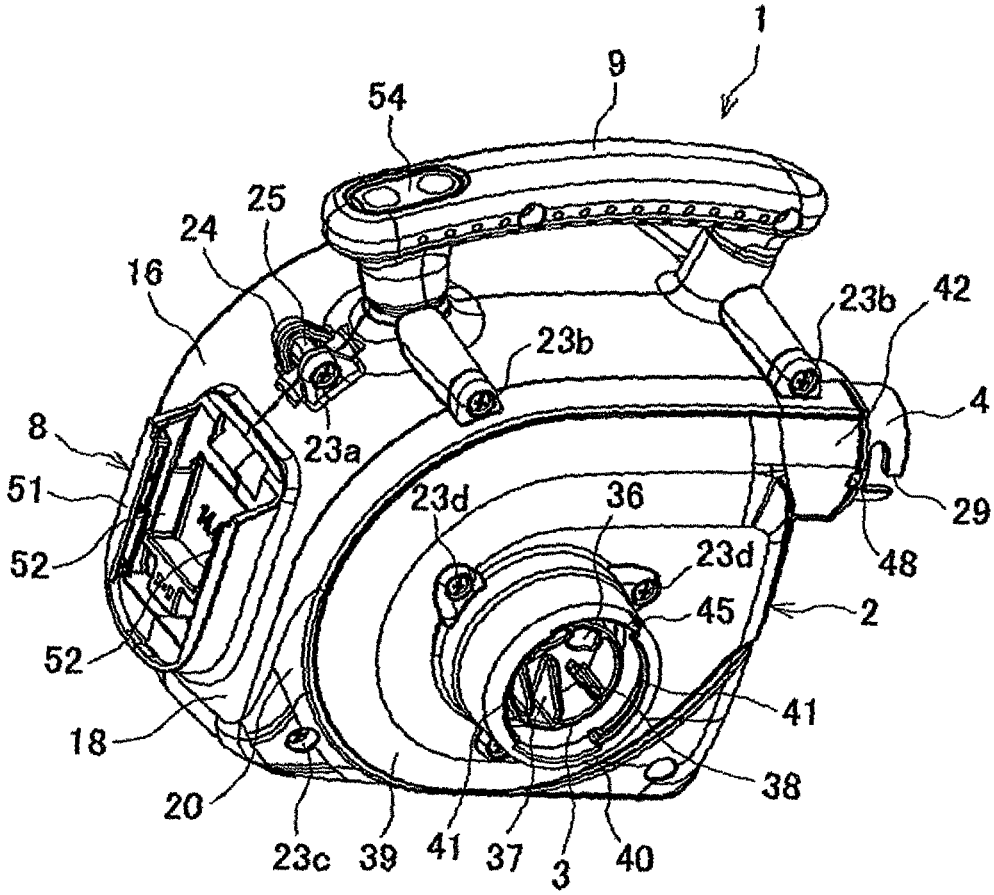
FIG. 3B is a perspective view of the main body of the dust collector as viewed from a front side.
Figure 4A:
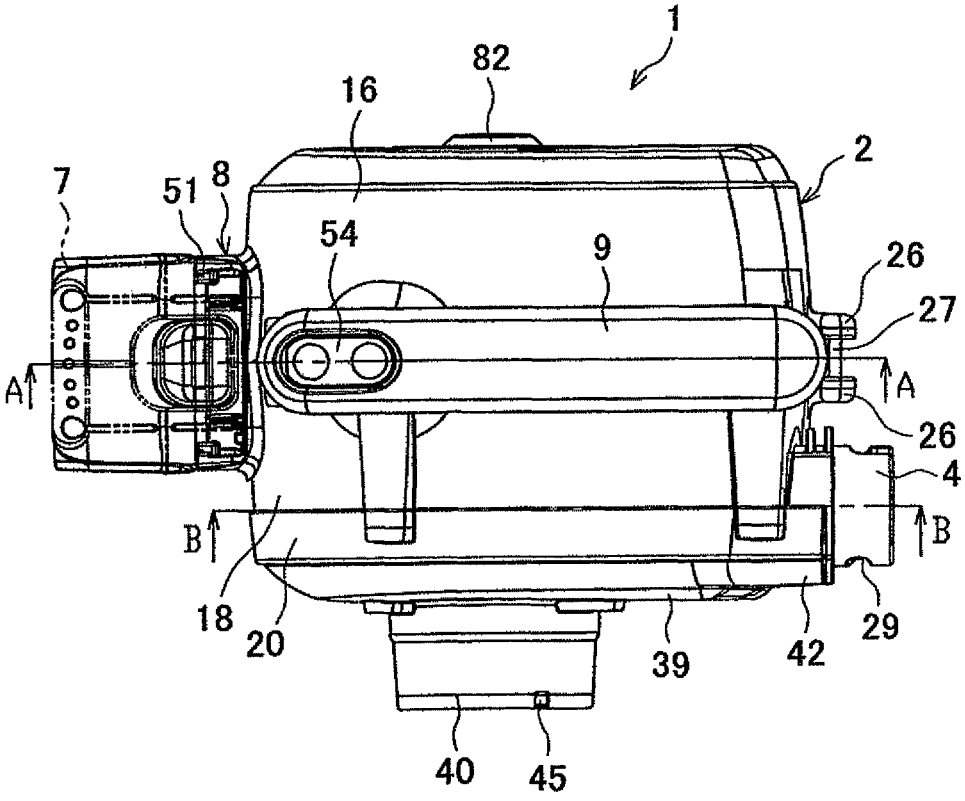
FIG. 4A is an explanatory diagram showing a plan view of the main body of the dust collector.
Figure 4B:
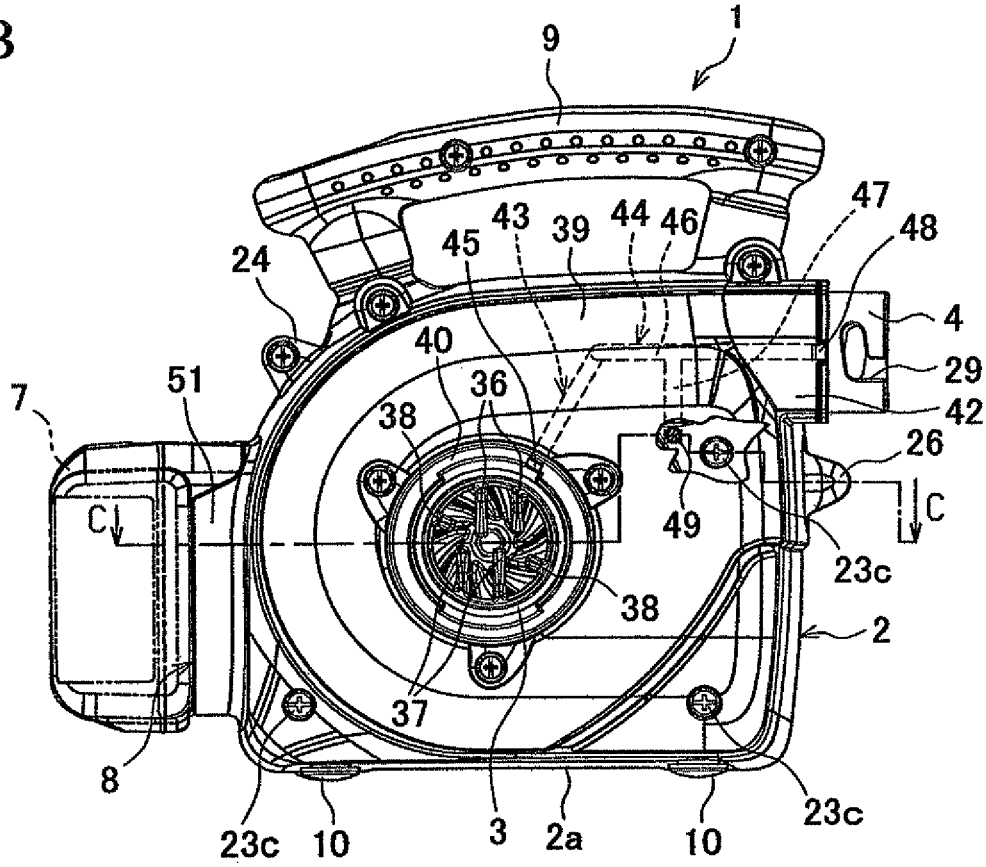
FIG. 4B is an explanatory diagram showing a front view of the main body of the dust collector.

As shown also in FIGS. 3-5, at an upper side of the main body 2, in a midsection (middle in the front-rear direction) thereof, a handle 9 is formed with its length arranged to extend in the left-right direction, and at an underside of the main body 2, a flat supporting surface 2*a* is formed on which caps 10 each having a spherical surface at an underside thereof (a tread which touches a floor or the ground) are fitted at the four corners of the supporting surface 2*a*.

The handle 9 is formed such that a thickness is smaller than a width, where the thickness is a dimension in the upward-downward direction and the width is a dimension in the front-rear direction. With this configuration, a hand grasping the handle 9 can afford an extra object, for example, a hose connected to the intake port 3 so that the both of the hose and the handle 9 can be grasped together at the same time by the single hand.

The reason that the underside of each cap 10 is formed spherically is that the housing of the main body 2 in this embodiment is composed of two divisional housings as will be described later which are separable to the front and to the rear, and each divisional housing may have a draft-derived taper, even in which case, the supporting surface should be able to be placed on a floor or the ground without rattling.

Specific Structures in Dust Collector

Figure 5B:
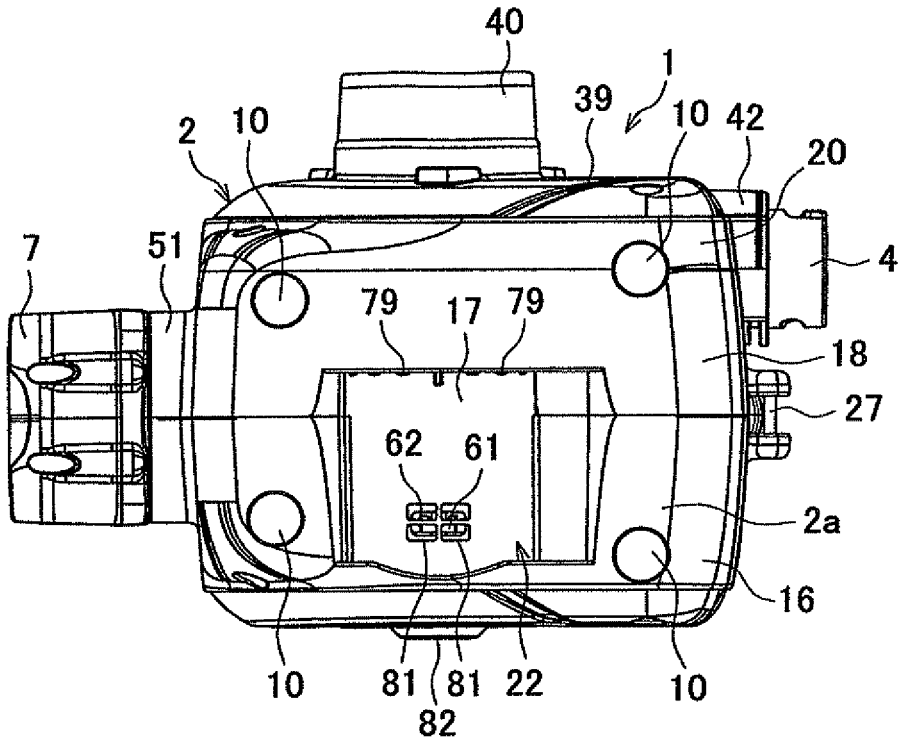
FIG. 5B is an explanatory diagram showing a bottom view of the main body of the dust collector.
Figure 6:
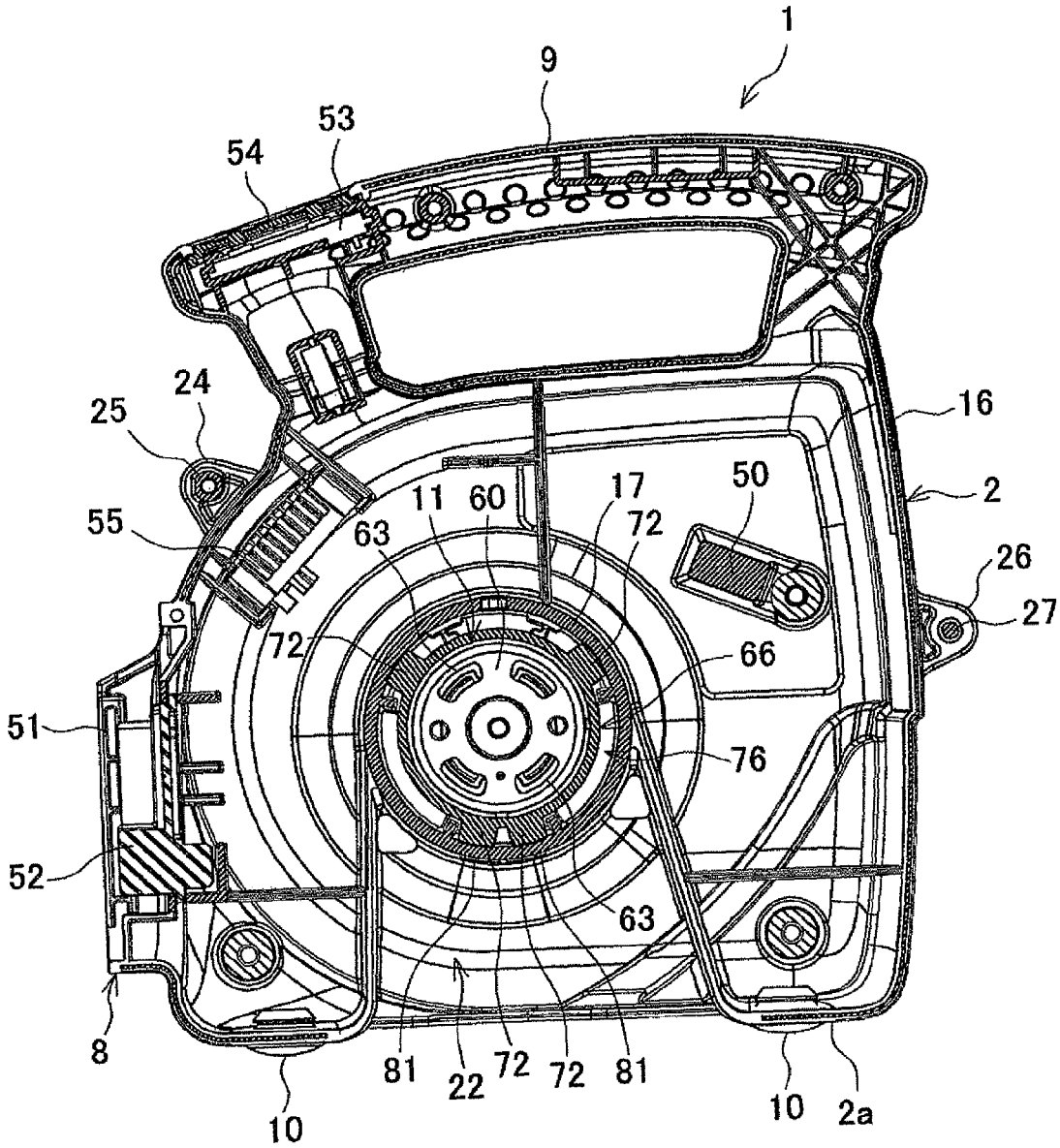
FIG. 6 is a section view of the dust collector (a battery pack omitted from illustration) taken along line A-A of FIG. 4A.
Figure 7:
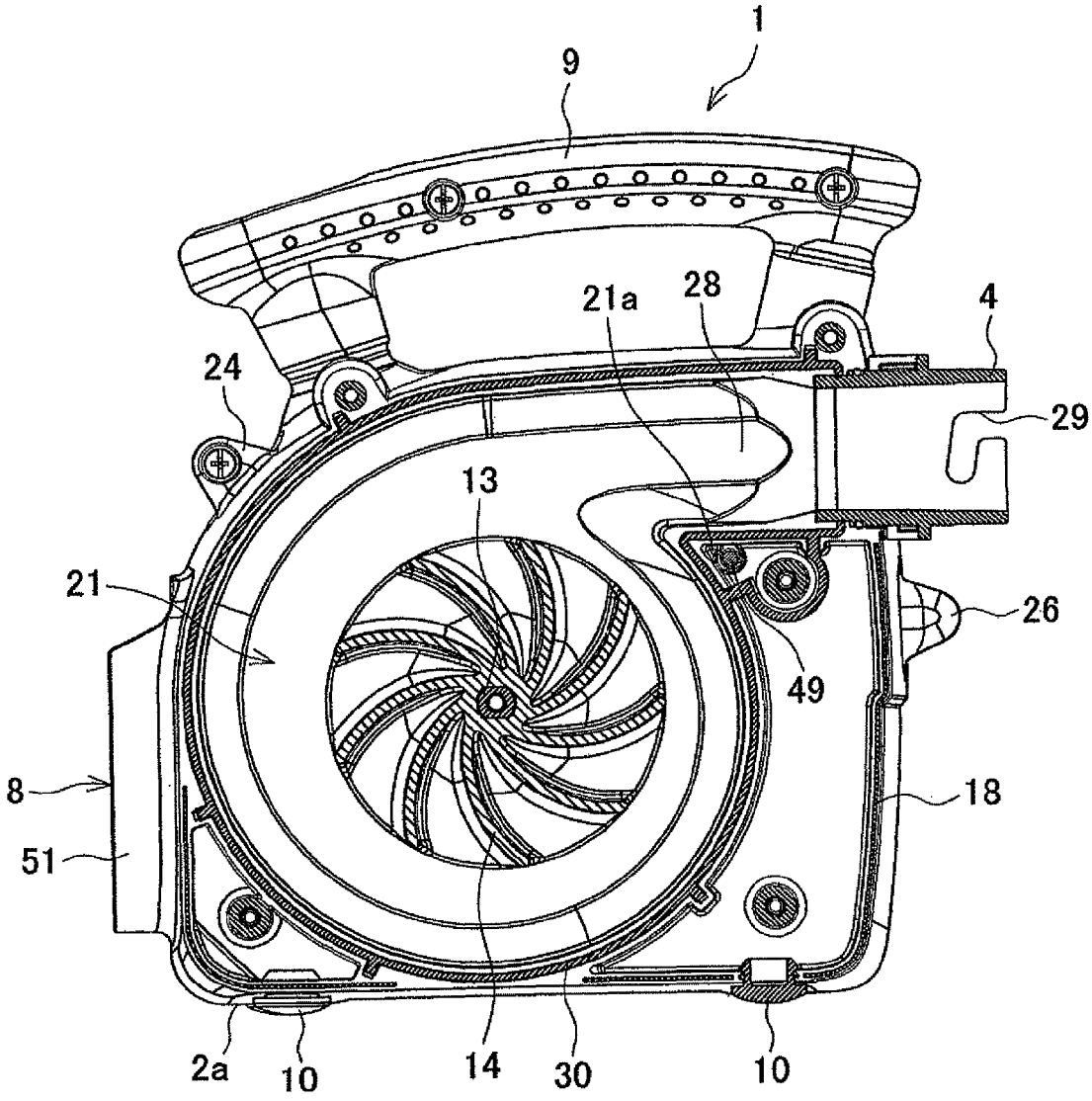
FIG. 7 is a section view of the dust collector (the battery pack omitted from illustration) taken along line B-B of FIG. 4A.
Figure 8:
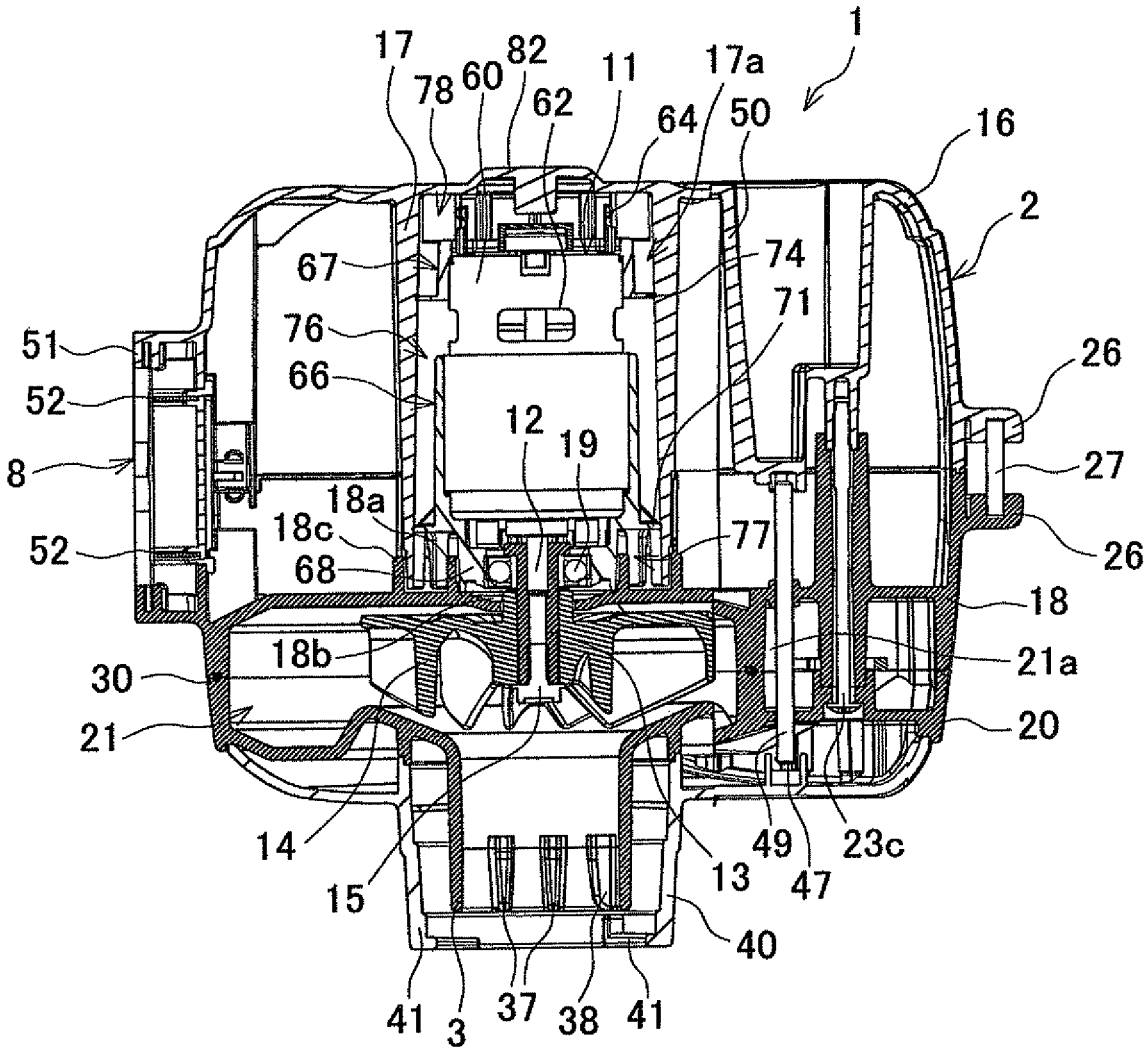
FIG. 8 is a section view of the dust collector (the battery pack omitted from illustration) taken along line C-C of FIG. 4B.

In the main body 2, as shown in FIGS. 6-8, a motor 11 is housed transversely with an output shaft 12 thereof oriented to the front, and a fan 14 is disposed perpendicularly to and attached to the output shaft 12 through an extension shaft 13 with a bolt 15. The motor 11 is housed in a holding tube 17 oriented frontward and standing on an inside of a rear wall of a motor housing 16 as a divisional housing which makes up a rear half of the main body 2. The extension shaft 13 is supported on ball bearings 19 at a rear side of a fan housing 18 as another divisional housing which is disposed frontwardly of and combined with the motor housing 16. A fan cover 20 as yet another divisional housing is disposed frontwardly of and combined with the fan housing 18 to form a scroll chamber 21 between the fan housing 18 and the fan cover 20. The extension shaft 13 is disposed to pierce through the fan housing 18 to locate the fan 14 at the center of the scroll chamber 21. Denoted by 22 is an opening provided at an underside of the main body 2 to expose a part of an underside of the holding tube 17 to the outside, as shown in FIG. 5B.

Figure 9:
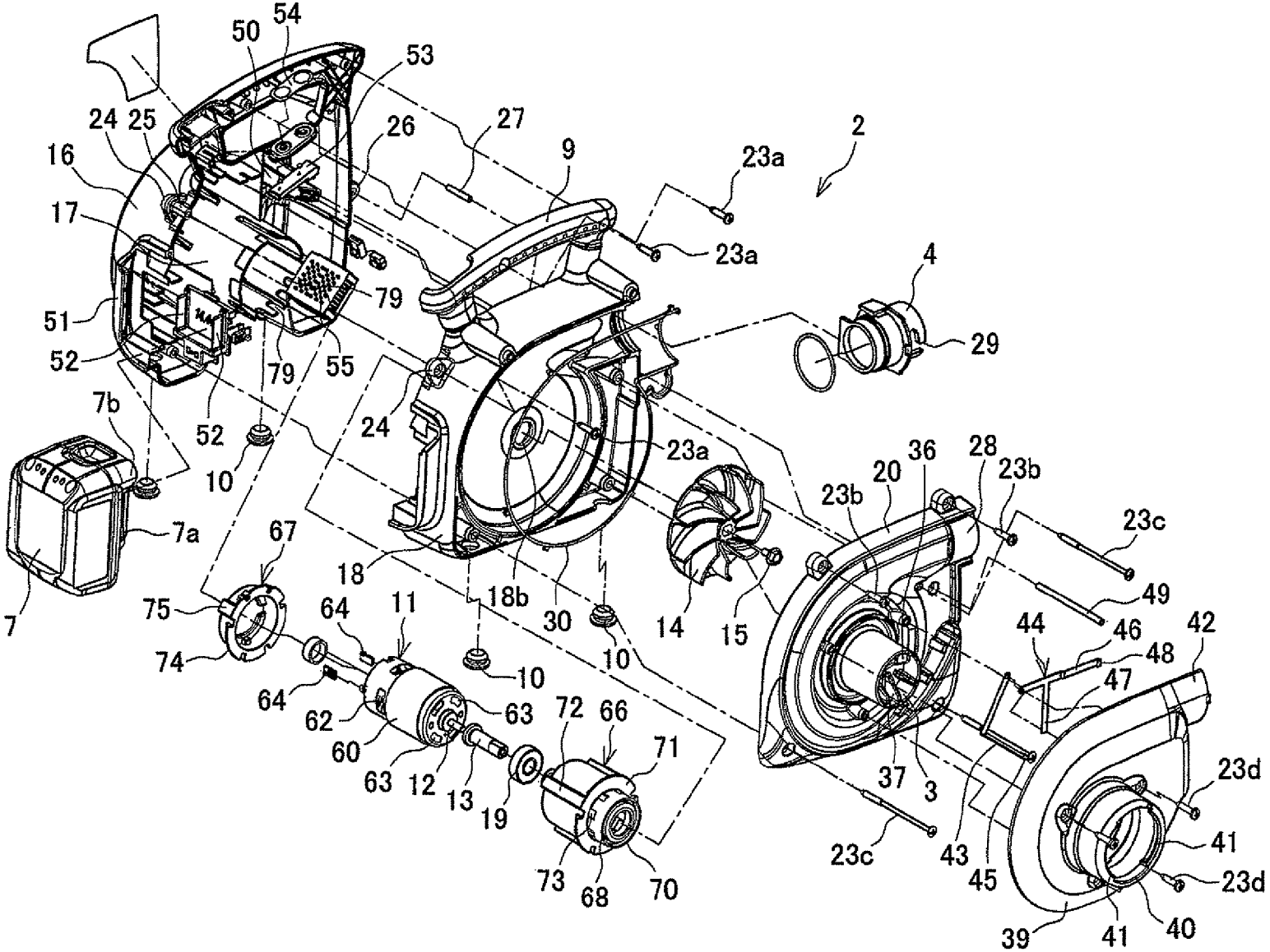
FIG. 9 is an exploded perspective view of the main body of the dust collector.

As shown also in FIG. 9, the motor housing 16 and the fan housing 18 are combined together at a substantially central position in the front-rear direction of the main body 2 and fastened to each other with a plurality of screws 23*a*. Adjacent to combined sides of the motor and fan housings 16, 18, a split half of the receptacle unit 8 of the battery pack 7 and a split half of the handle 9 are provided, respectively. A pair of projections 24 are also provided adjacent to the combined sides of the motor and fan housings 16, 18 in positions corresponding to each other between the receptacle unit 8 and the handle 9, such that the projections 24 are fastened together by a screw 23*a* applied through a hole provided at one of the projections 24 (in this embodiment, projection 24 of the fan housing 18) into a boss 25 provided at one of the projections 24 (in this embodiment, projection 24 of the motor housing 16). This boss 25 serves as a belt-fastening part configured to allow a hook provided at one end of a belt (not shown) for hanging to be fastened thereto. Similarly, at the right side of the main body 2, a pair of projections 26 are provided adjacent to the combined sides of the motor and fan housings 16, 18 in positions corresponding to each other. A pin 27 is provided to extend between these projections 26, and serves as a belt-fastening part configured to allow another hook provided at the other end of the belt to be fastened thereto.

The fan cover 20 is fixed to the fan housing 18 by screws 23*b*, and further securely tightened by long screws 23*c* which are applied from the front side through the fan cover 20 and the fan housing 18 to the motor housing 16.

The intake port 3 is provided in, and integrally formed with, the fan cover 20 coaxially with the output shaft 12 of the motor 11 and a shaft of the fan 14. The exhaust port 4 is formed of a separately formed tubular part held between the combined sides of the fan housing 18 and the fan cover 20. This exhaust port 4 is disposed coaxially with and connected to a conduit 28 which are formed to extend from an upper side of the scroll chamber 21 in a lateral and tangential direction. Denoted by 29 are a pair of L-shaped slots formed at an open end of the exhaust port 4. A sealing material 30 is held between the combined sides of the fan housing 18 and the fan cover 20, along the circumference of the scroll chamber 21 and the edge of the opening of the exhaust port 4.

Figure 10:
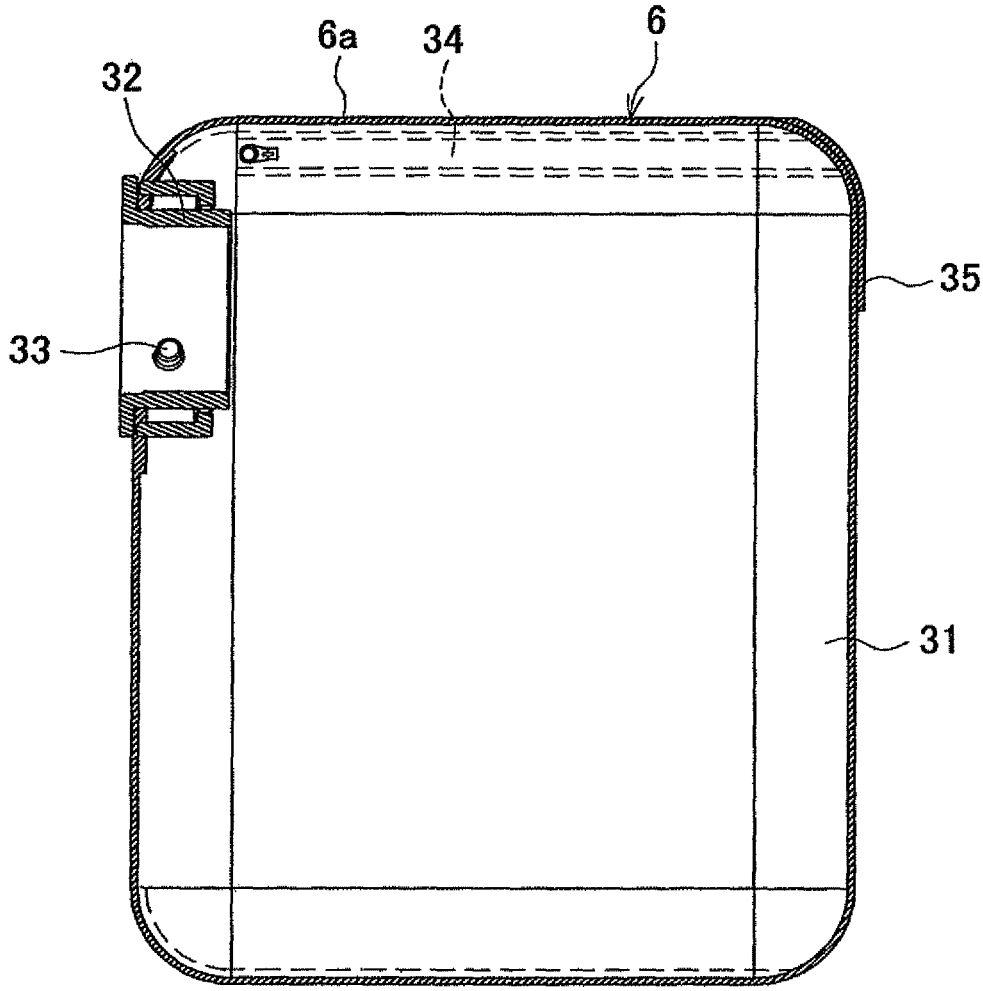
FIG. 10 is a vertical section view of a bag main body of a dust bag.

As shown in FIG. 10, the dust bag 6 includes a cloth bag body and a coupling tube 32 connected at an opening of the cloth bag body 31. The coupling tube 32 has a pair of pins 33 provided at an inside thereof and protruding inwardly, which pins 33 pass through the L-shaped slots 29 of the exhaust port 4 when the coupling tube 32 of the dust bag 6 is fitted on an outside of the exhaust port 4, so that the bayonet coupling is achieved. At an upper portion of the bag body 31, a fastener 34 is provided along three sides except a side facing the main body 2 and thus shaped like a letter U as viewed from above, so that the upper portion of the bag body 31 serves as a lid 6*a* which can be opened and closed as desired. Denoted by 35 is a belt-like cover of which one of two ends along the length is sewn along the lid 6*a*. When the lid 6*a* is closed with the fastener 34, the fastener 34 is covered with and hidden behind the cover 35.

In the fan cover 20, a plurality of ribs 36-38 are formed at an inside of the intake port 3. These ribs 36-38 include a pair of upper ribs 36 protruding downward from an upper side of an open inner surface of the intake port 3, a pair of lower ribs 37 protruding upward from a lower side of the open inner surface of the intake port 3, and a pair of slanting ribs 38 protruding obliquely from positions leftward and rightward adjacent to the upper and lower rib pairs 36 and 37, respectively, in a direction opposite to each other along a direction of a radius crossing through an axis of the intake port 3 as viewed from the front. Among these ribs 36-38, the upper rib pair 36 and the lower rib pair 37 extend downwardly and upwardly, respectively, up to positions proximity to each other and both short of the vertically middle position within the intake port 3, and are shifted to the right and to the left, respectively, so as to be in a mutually staggered arrangement. The slanting ribs 38 extend radially for a distance shorter than the upper and lower ribs 36 and 37. These ribs 36-38 extend in the direction of the axis of the intake port 3 from an outer end of the opening to a position substantially half a distance short of an inner end of the opening, and inwardly protruded ends of these ribs 36-38 slope in such a manner that the closer to the outer end of the opening, the smaller the amount of protrusion of each rib 36-38 becomes.

Figure 11:
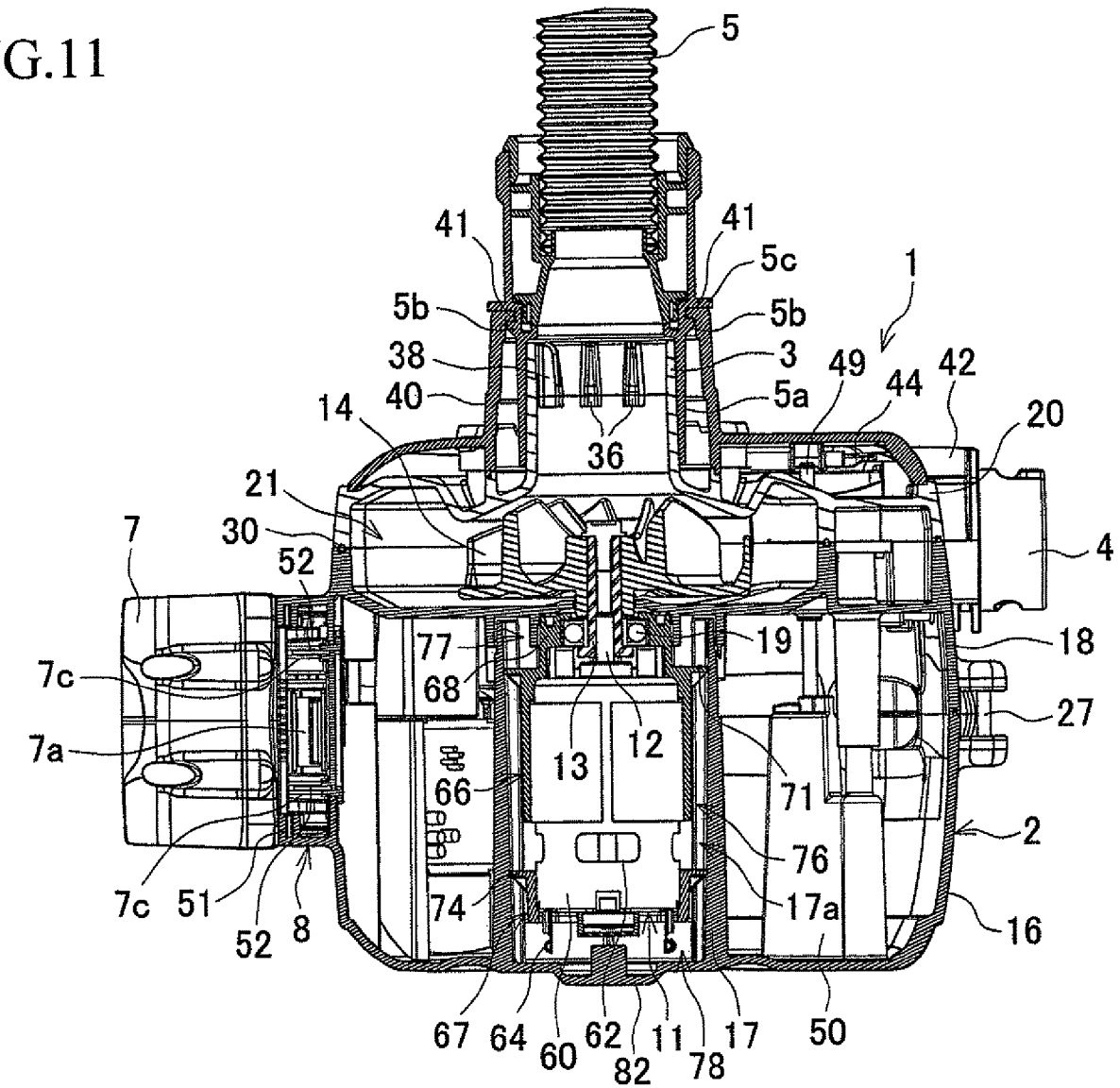
FIG. 11 is an explanatory diagram showing a section view of the main body of the dust collector.
Figure 12:
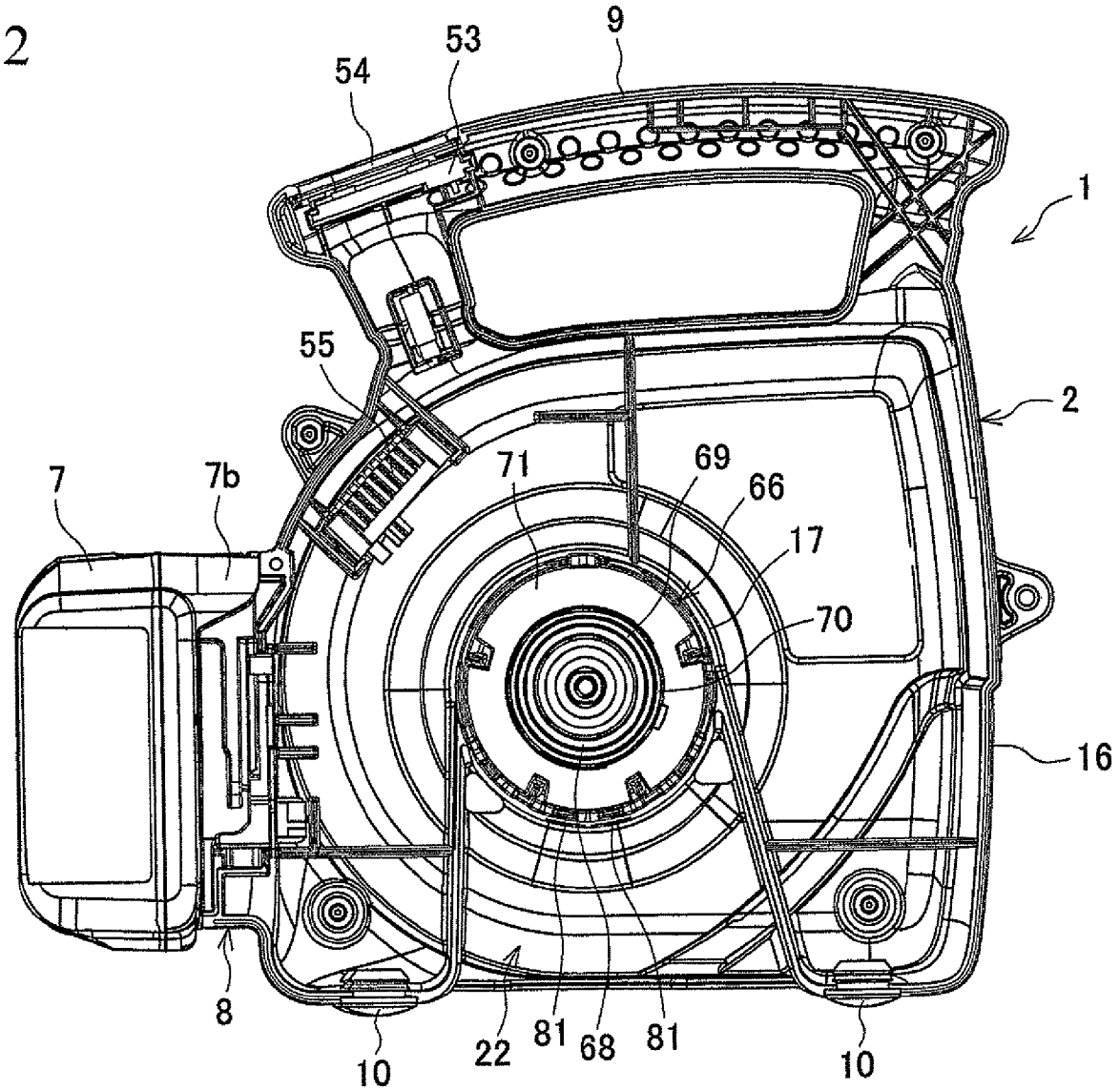
FIG. 12 is a front view of the main body of the dust collector from which a fan housing is removed.

A front cover 39 is attached to a front side of the fan cover 20. The front cover 39 is fastened by screws 23*d* applied from the front of the fan cover 20, and configured to generally entirely cover a front side of the fan cover 20 over the scroll chamber 21 and the conduit 28. A connecting tube 40 disposed outside of and coaxially with the intake port 3 is provided at the center of the front cover 39. The connecting tube 40 is, as shown in FIG. 11, configured to have dimensions outwardly covering an end portion 5*a* of the hose 5 fitted on the intake port 3 and protruding frontward beyond the intake port 3. At an edge of the opening of the connecting tube 40, a pair of ridges 41 are provided point-symmetrically which engage with a pair of projections 5*b* provided at the end portion 5*a*. Accordingly, the end portion 5*a* of the hose 5 can be coupled to the connecting tube 40 and brought into a state where the end portion 5*a* is prevented from being disconnected thereto, by fitting the end portion 5*a* of the hose 5 onto the intake port 3 with the projections 5*b* being phase-shifted from the ridges 41, pushing the end portion 5*a* of the hose 5 into the connecting tube 40 until a flange 5*c* provided at a circumference of the end portion 5*a* comes in contact with the connecting tube 40, and rotating the end portion 5*a* of the hose 5 until the projections 5*b* become phase-matched with the ridges 41.

At an inside of the front cover 39, as shown in FIG. 9, a first grounding plate 43 and a second grounding plate 44 which are made of metal are provided. The first and second grounding plates 43, 44 are configured to electrically connect the opening of the connecting tube 40 and a protruding end portion 42 provided to cover a front side of the conduit 28. The first grounding plate 43 is shaped like a letter L of which one leg is disposed to protrude frontward along an inner surface of the connecting tube 40 and a front end portion 45 thereof bent like a hook is engaged with the opening of the connecting tube 40. The other leg of the first grounding plate 43 disposed to extend in an upper right direction along an inner surface of the front cover 39. On the other hand, the second grounding plate 44 is shaped like a letter T composed of a lateral rod portion 46 extending in the right-left direction and a vertical rod portion 47 extending in the upward-downward direction. The left end of the lateral rod portion 46 is brought into contact with the right end of the first grounding plate 43, and the right end of the lateral rod portion 46 is bent like a hook and engaged with the protruding end portion 42 of the front cover 39.

Denoted by 49 is a grounding pin made of metal which is disposed to extend in the front-rear direction through the fan cover 20 and the fan housing 18 in a tongue portion 21*a* (see FIG. 7) formed at a basal portion of the conduit 28 outside of the scroll chamber 21. A front end of the grounding pin 49 is in contact with a lower end of the vertical rod portion 47 of the second grounding plate 44. A rear end of the grounding pin 49 is brought into contact with a front surface of a boss 50 for a screw and positioned in place. The boss 50 is provided to protrude from the rear side of the motor housing 16. The rear end of the grounding pin 49 is thus electrically connected with the motor 11 via a ground wire (not shown).

The end portion 5*a* of the hose 5 and the coupling tube 32 of the dust bag 6 are formed, for example, of a conductive resin such as a carbon-containing polypropylene. When the hose 5 is connected to the connecting tube 40, the end portion 5*a* comes in contact with the front end portion 45 of the first grounding plate 43. When the dust bag 6 is connected to the exhaust port 4, the coupling tube 32 comes in contact with the right end portion 48 of the second grounding plate 44.

On the other hand, the receptacle unit 8 of the battery pack 7 includes a pair of terminal plates 52 disposed in parallel and protruding vertically within a ridge 51 protruding along a U-shaped line from the left side of the main body 2. When an engageable portion 7*a* provided on an upper side of the battery pack 7 is placed from above into the ridge 51 of the main body 2, and slid downward until a stopper 7*b* provided at the engageable portion 7*a* comes in contact with an upper end of the ridge 51, the engageable portion 7*a* is coupled with the ridge 51 and the terminals 7*c* are electrically connected with the terminal plates 52 as shown in FIG. 11, 12 so that the battery pack 7 attached to the main body 2 (receptacle unit 8) is located across the motor housing 16 and the fan housing 18. In this state, a center of gravity of the battery pack 7 is in a position lower than that of a center of gravity of the main body 2. Here, the center of gravity of the battery pack 7 attached to the main body 2 is in a position lower than that of the center of gravity of the main body 2 having no battery pack attached thereto. Removal of the battery pack 7 is performed by sliding the engageable portion 7*a* upward away from the ridge 51.

Denoted by 53 is a switch unit provided at a left end of the handle 9. A switch plate 54 configured to be operable to expose an ON/OFF operation part through an upper surface of the handle 9 is provided at an upper portion of the switch unit 53. The switch unit 53 is electrically connected to the terminal plate 52 of the receptacle unit 8 and to a controller 55 disposed within the main body 2.

Figure 13A:
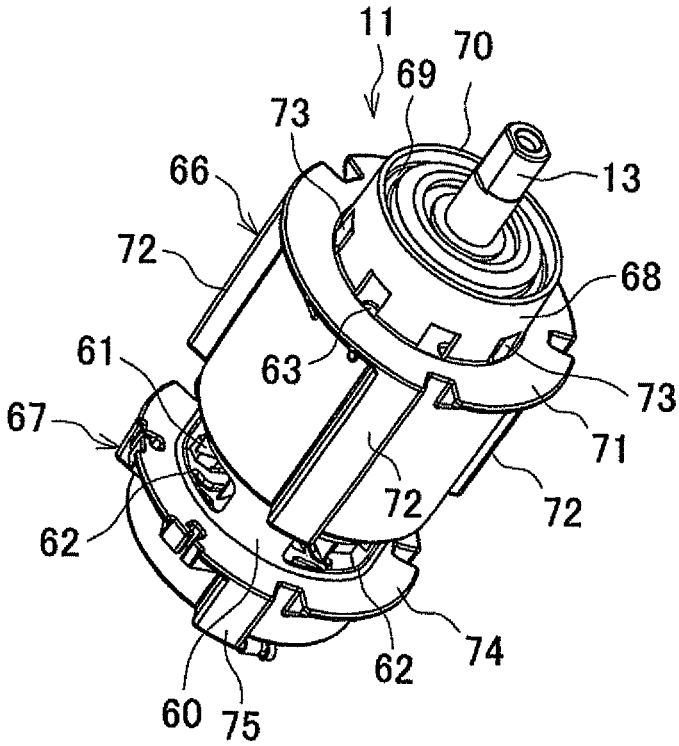
FIG. 13A is an explanatory diagram showing a perspective view of a motor as viewed from a front side.
Figure 13B:
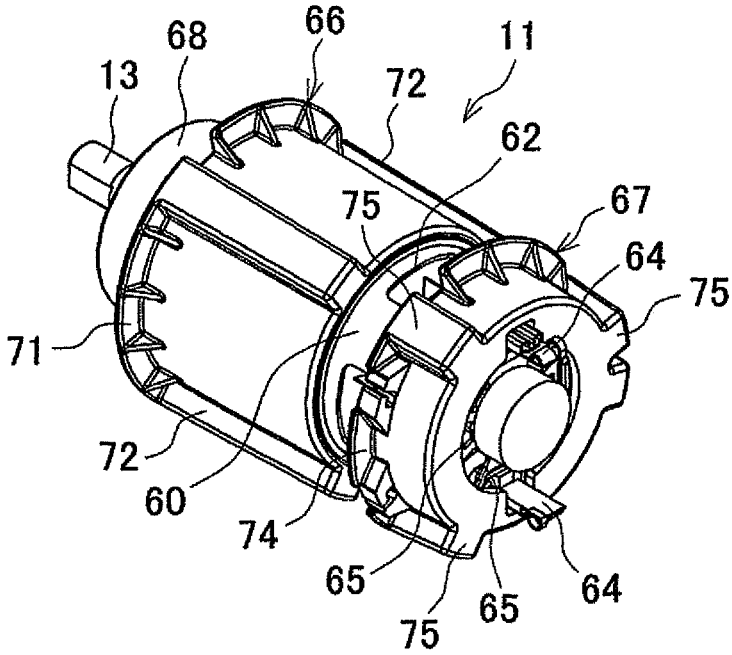
FIG. 13B is an explanatory diagram showing a perspective view of the motor as viewed from a rear side.
Figure 13C:
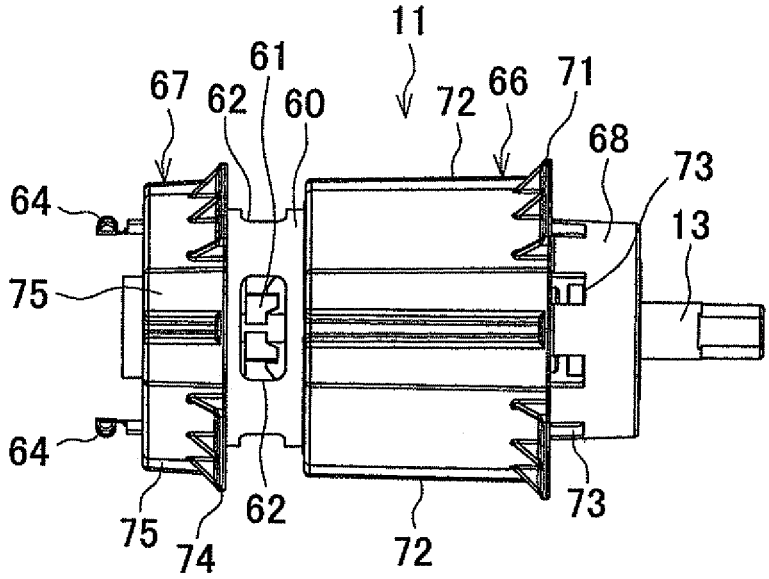
FIG. 13C is an explanatory diagram showing a side view of the motor.

As shown in FIG. 13, the motor 11 includes a casing 60 and a cooling fan 61 disposed rearwardly of the output shaft 12 within the casing 60. The cooling fan 61 is exposed to the outside through middle windows 62 which are circumferentially oblong holes formed in the casing 60. At a front side of the casing 60, circumferentially oblong front windows 63 are formed. At a rear side of the casing 60, terminals 64 are protrusively provided and circumferentially oblong rear windows 65 are formed.

Figure 14A:
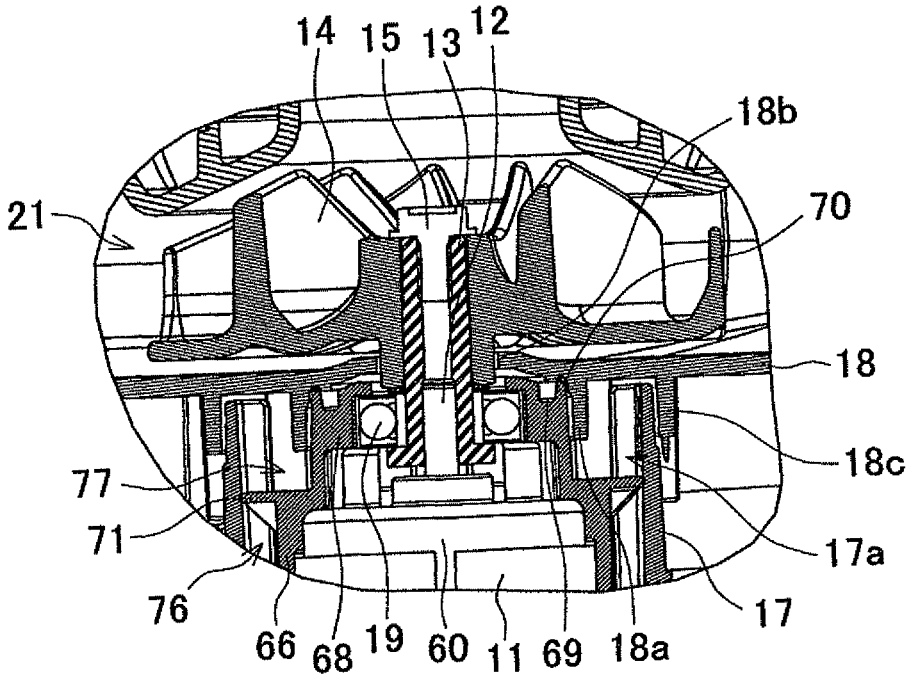
FIG. 14A is an enlarged section view showing a fan and therearound in the main body of the dust collector, in a steadily operating state.

Rubber covers 66, 67 are attached to the front and rear portions of the casing 60, respectively. The front portion of the casing 60 covered by the front rubber cover 66 extends frontward, from a position frontward of the middle windows 62. A central portion of a front side of the rubber cover 66 is configured to protrude frontward farther than the front side of the casing 60, to form a holding ring 68 which holds the ball bearings 19. This holding ring 68 is, as shown also in FIG. 14A, fitted in an annular inner retaining wall 18*a* protrusively provided on the rear surface of the fan housing 18, so that a communication portion 18*b* having a through hole through which the extension shaft 13 and the fan 14 pierce is formed between the front end of the holding ring 68 and the rear surface of the fan housing 18. Denoted by 18*c* is an annular outer retaining wall which is protrusively provided at an outside of the inner retaining wall 18*a* on the rear surface of the fan housing 18, and configured such that an end portion of the holding tube 17 is fitted in the outer retaining wall 18*c*. A motor chamber 17*a* which accommodates the motor 11 is formed in the motor housing 16 by the outer retaining wall 18*c* and the holding tube 17.

In a front-end surface of the holding ring 68, an annular groove 69 is formed coaxially to form a thin seal portion 70 at an outer circumferential edge of the front end. An outer peripheral surface of the holding ring 68 which includes the seal portion 70 is located in proximity to the inner peripheral surface of the inner retaining wall 18*a*, and a space between the outer peripheral surface of the holding ring 68 and the inner peripheral surface of the inner retaining wall 18*a* provide a passage through which the motor chamber 17*a* and the scroll chamber 21 communicate with each other.

In addition, a front flange 71 is provided circumferentially at a midsection (near the front end of the casing 60) of the rubber cover 66. The front flange 71 has an outer peripheral surface in contact with the inner peripheral surface of the holding tube 17. At a rearward section (located rearwardly from the front flange 71) of the outer peripheral surface of the rubber cover 66, a plurality of axially extending ridges 72 each protruding radially outwardly to the same height as that of the front flange 71 are provided in positions spaced around the circumference of the rubber cover 66. Denoted by 73 is an opening provided frontwardly of the front flange 71 in the holding ring 68 to provide a passage through which the front window 63 communicates with the outside.

On the other hand, the rear rubber cover 67 is shaped like a sleeve configured to cover a rear portion (except the terminals 64 and the rear window 65) of the casing 60. The rear portion covered by the rear rubber cover 67 extends rearward, from a position rearward of the middle windows 62. A rear flange 74 is provided circumferentially at a front end of the rubber cover 67. The rear flange 74 has an outer peripheral surface in contact with the inner peripheral surface of the holding tube 17. At a rearward section (located rearwardly from the rear flange 74) of the outer peripheral surface of the rubber cover 67 as well, a plurality of axially extending ridges 75 each protruding radially outwardly to the same height as that of the rear flange 74 are provided in positions spaced around the circumference of the rubber cover 67 and phase-matched with the ridges 72.

Accordingly, in the motor chamber 17*a*, a middle space 76 in communication with the middle window 62, a front space 77 in communication with the front window 63, and a rear space 78 in communication with the rear window 65 are formed by partitioning with the front and rear flanges 71, 74 provided on the rubber covers 66, 67, respectively.

In this embodiment, the rubber covers 66, 67 are made of a chloroprene or CR rubber, and the front rubber cover 66 (located in a position closer to the output shaft 12 of the motor 11) has a hardness of 40 Hs (JIS-A) while the rear rubber cover 67 (located in a position farther from the output shaft 12 of the motor 11) has a hardness of 30 Hs (JIS-A). In this way, the hardness of the rear rubber cover 67 is set to be lower than that of the front rubber cover 66. The reason why the hardness of the front rubber cover 66 is set to be 40 Hs is that the hardness lower than 40 Hs would disadvantageously cause the motor 11 to rattle at its front side when the motor 11 is driven, and cause the fan 14 to interfere with the fan housing 18 or other parts within the scroll chamber 21. Thus, the above value (40 Hs) of the hardness of the front rubber cover 66 has been selected and set because it is the value of hardness with which the rattling can be prevented and the required vibration-insulating effects can be achieved. On the other hand, the hardness of the rear rubber cover 67 has been selected and set as mentioned above (30 Hs) because it is an adequate value that is the lowest value possible of the hardness of the CR rubber realized without incurring additional costs.

Figure 5A:
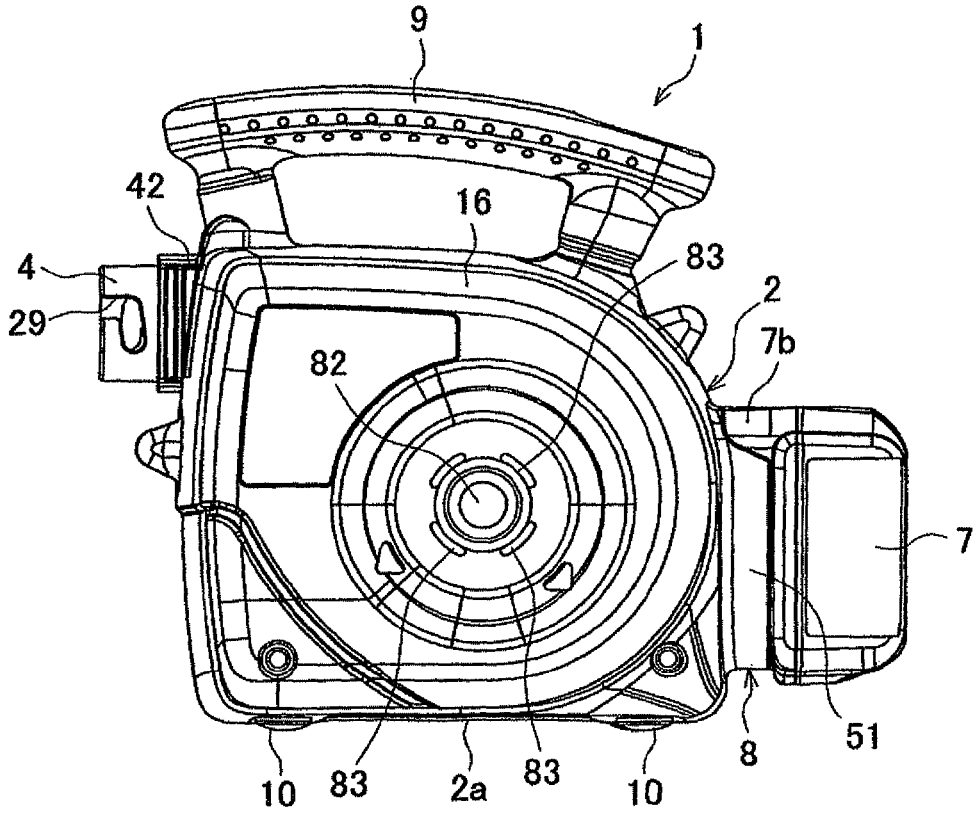
FIG. 5A is an explanatory diagram showing a rear view of the main body of the dust collector.

In the motor housing 16, as shown in FIGS. 5A and 5B, air outlets 81 are formed at a bottom portion of the holding tube 17 facing to the opening 22, whereas a cylindrical projection 82 configured coaxially with the output shaft 12 and protruding rearward are formed at a rear side (rearwardly of the motor 11) of the motor housing 16, with a plurality of oblong air inlets 83 located adjacent to and radially outside the cylindrical projection 82. With this configuration, the middle space 76 within the motor chamber 17*a* is in communication with the outside of the main body 2 through the air outlets 81, and the rear space 78 within the motor chamber 17*a* is in communication with the outside of the main body 2 through the air inlets 83. At a lower side of the front-end portion of the holding tube 17, as shown in FIG. 9, indentations 79 are formed to provide a passage to make the front space 77 in communication with the opening 22.

Operation of Dust Collector

The dust collector 1 configured as described above operates as follows. As shown in FIG. 1, the dust collector 1 is placed on a floor or the like with a hose 5 attached to the intake port 3, a dust bag 6 attached to the exhaust port 4, and a battery pack 7 attached to the receptacle unit 8. When the switch plate 54 is turned ON, the motor 11 is driven to cause the fan 14 to spin according as the output shaft 12 rotates. Accordingly, outside air is sucked through the intake port 3 from the hose 5, circulated through the inside of the scroll chamber 21, and discharged through the conduit 28 from the exhaust port 4. When the hose 5 is connected to a power tool or the like, dust which is sucked together with outside air is discharged from the exhaust port 4 and caught and collected in the dust bag 6.

On the other hand, when the hose 5 is removed from the intake port 3 and a nozzle (not shown) is connected to the exhaust port 4, the dust collector 1 can be used as a blower. In this operation, the dust collector 1 can be carried by grasping the handle 9, or carried with a belt fastened to the boss 25 and the pin 27 and looped over an operator's shoulder. The use of the dust collector 1 as a blower may be made without carrying the dust collector 1. For example, if a hose is connected to the exhaust port 4, the hose may be manipulated to direct air in a desired direction with the main body 2 placed stationarily on the ground or the like.

In the main body 2, when the motor 11 is driven to spin the cooling fan 61, first, outside air at a rear side of the motor 11 is sucked from an air inlet 83 into the motor chamber 17*a*, and directed through the rear window 65 into the casing 60. The air passing forward through the casing 60 is discharged through the middle window 62 into a middle space 76, and released from an air outlet 81 through the opening 22 to the outside of the main body 2.

Air at a front side of the motor 11 is sucked from the opening 22 through a cutaway portion 79, passes through a front space 77 and an opening 73, and is directed through the front window 63 into the casing 60. The air passing rearward through the casing 60 is discharged through the middle window 62 into the space 76, and released from the air outlet 81 through the opening 22. These air passages serve to cool the motor 11.

The middle space 76 into which air after cooling the motor 11 is discharged, is partitioned by front and rear flanges 71, 74 from the front and rear spaces 77, 78 through which air before cooling the motor 11 passes. Therefore, the air after cooling the motor 11 would never be sucked again into the casing 60 for recirculation within the motor chamber 17*a*. As a result, fresh air can always be used to cool the motor 11.

Moreover, in this embodiment, the motor 11 is fixed through front and rear rubber covers 66, 67 inside the holding tube 17, and thus vibrations associated with the operation of the motor 11 is not likely to be transmitted to the main body 2. In particular, the hardness of the rear rubber cover 67 is set to be lower, and thus even if vibrations around the axis of the output shaft 12 occur, the rear portion of the motor 11 may be turned about the axis of the output shaft 12 so that the vibrations can be absorbed effectively.

Figure 14B:
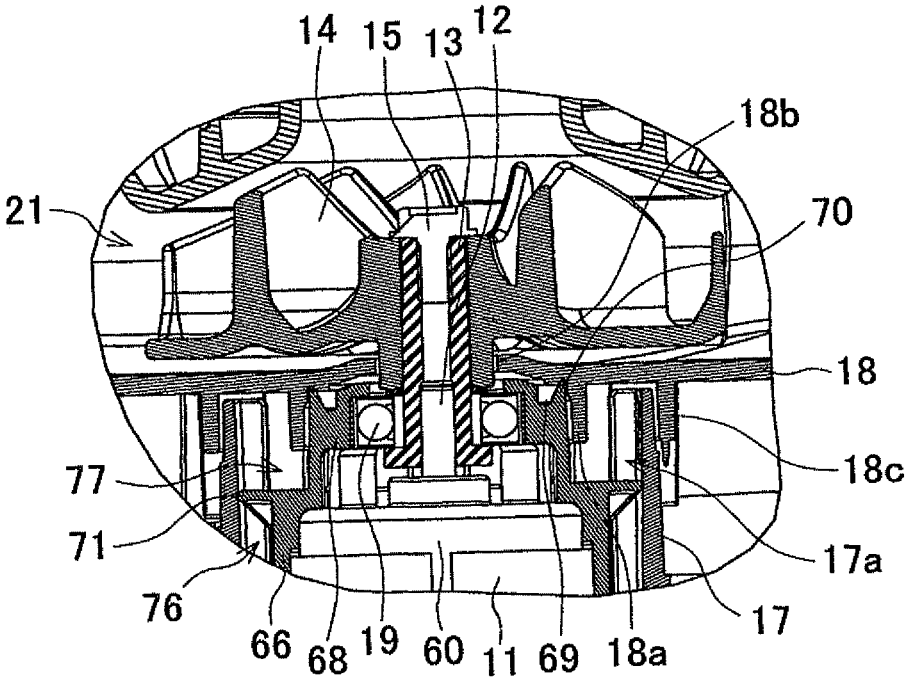
FIG. 14B is an enlarged section view showing the fan and therearound in the main body of the dust collector, in a state where an internal pressure of a scroll chamber has built up.

On the other hand, when dust is stored and accumulated in the dust bag 6 and an exhaust resistance increases, the pressure in the scroll chamber 21 increases, and the pressure in a communication portion 18*b* which is in communication with the scroll chamber 21 also increases. Then, as shown in FIG. 14B, a holding ring 68 is pushed from the front and radially expand so that a seal portion 70 is pressed by an inner peripheral surface of an inner retaining wall 18*a* and the communication portion 18*b* is sealed. Accordingly, even if dust is stored and accumulated in the scroll chamber 21, the dust would not likely enter the front space 77 within the motor chamber 17*a*, and thus the dustproof property of the motor 11 can be maintained.

Since the ribs 36-38 are provided in the intake port 3, a filtering function is exerted such that large chips or dust can be blocked thereat, and would never be sucked into the scroll chamber 21.

Furthermore, when the dust-collecting operation is performed, if the dust sucked from the intake port 3 is made of material which tends to be negatively charged such as chips or the like, negatively charged static electricity is produced by friction with the end portion 5*a* and the intake port 3, and the end portion 5*a* and the intake port 3 becomes positively charged. Thereafter, when the charged dust passes through the scroll chamber 21 and is discharged from the exhaust port 4, the dust comes in contact with the exhaust port 4 and the coupling tube 32, and the negative charges are transferred to the exhaust port 4 and the coupling tube 32. Since the end portion 5*a* of the hose 5 and the coupling tube 32 are electrically connected to each other via the first and second grounding plates 43, 44, the positive charge at the intake side and the negative charge at the exhaust side are coupled through the first and second grounding plates 43, 44 and vanished. Similarly, even if the fan 14 is positively charged by friction with the dust, the positive charges are coupled with the negative charges transferred through the grounding pin 49 to the motor 11, and vanished.

Advantageous Effects of Dust Collector

According to the dust collector 1 configured as described above, in which the receptacle unit 8 configured to allow the battery pack 7 to be attached thereto, the handle 9 capable of being grasped, and the boss 25 and the pin 27 configured to allow a belt to be fastened thereto are provided, while the supporting surface 2*a* configured to allow the dust collector 1 with the dust bag 6 and the battery pack 7 attached thereto to be placed thereon are provided at the underside of the main body 2, two modes of operation which an operator may select become available: a portable use mode and a stationary use mode. The portable use mode is the mode in which the main body 2 is carried using a handle 9 or a belt; the stationary use mode is the mode in which the main body 2 is set in place stationarily on a floor or the like. In particular, since the dust bag 6 is provided externally without the need to provide a dust-collecting space within the main body 2, the main body 2 can be designed to be compact in size and light in weight with an improved handleability during operation in the portable use mode as a blower, which thus increases the work efficiency.

On the other hand, since the main body 2 includes a housing that is an assembly composed of at least two divisional housings (including the motor housing 16 and the fan housing 18), across which the battery pack 7 attached to the receptacle unit 8 is located, the battery pack 7 can be attached with a proper balance attained, and thus, improvements in stability can be expected and the terminals 52 can be connected with increased ease.

Since the handle 9 is provided at an upper portion of the main body 2, and the exhaust port 4 and the receptacle unit 8 are provided at opposite sides of the main body 2, at the right side and at the left side, respectively, whereby the battery pack 7 attached to the receptacle unit 8 and the dust bag 6 attached to the exhaust port 4 are located oppositely to laterally sandwich the main body 2 as viewed from a front side of the main body 2, a proper balance can be attained during operation in the portable use mode, and thus the handleability can be improved.

Since the handle 9 is configured to extend laterally as viewed from the front side of the main body 2 in a direction along which the dust bag 6 attached to the exhaust port 4 and the battery pack 7 attached to the receptacle unit 8 are arranged, for example, when an operator grasps the handle 9 at his/her body side, the dust collector 1 naturally becomes oriented with the dust bag 6 and the battery pack 7 arranged in the front-rear direction, and thus the operation in the portable use mode can probably be performed without being interfered with by the dust bag 6 and the battery pack 7. Since the receptacle unit 8 is configured to allow the battery pack 7 to be slid therealong from above the main body 2 and thereby combined with the receptacle unit 8, the attachment and detachment of the battery pack 7 to and from the receptacle unit 8 before and after the operation in the stationary use mode can be performed with increased ease, and the risk of accidental drop of the battery pack 7 from the receptacle unit 8 can be avoided.

Since the center of gravity of the battery pack 7 attached to the receptacle unit 8 is in a position lower than that of the center of gravity of the main body 2 having no battery pack 7 attached to the receptacle unit 8, the stability of the dust collector 1 can be improved furthermore.

Since the motor 11 is accommodated in the holding tube 17 through the rubber covers 66, 67, vibration-insulating effects on the main body 2 and shock-absorbing effects on the motor 11 can be achieved.

Furthermore, since the rubber covers 66, 67 have a divided structure composed of the front cover 66 (disposed in a position closer to the output shaft 12) and the rear cover 67 (disposed in a position farther from the output shaft 12), and the hardness of the rear rubber cover 67 is set to be lower than that of the front rubber cover 66, vibrations around the axis of the output shaft 12 of the motor 11 can be absorbed effectively.

Modified Embodiments of Dust Collector

The dust collector consistent with the present invention is not limited to the above-described illustrative embodiment, but any modifications in design can be made where appropriate; for example, the exhaust port and the receptacle unit may be arranged reversely, i.e., at the left and at the right, respectively, of the main body; the battery pack may be configured to be combined with the main body by sliding the battery pack from the front or from the rear along the receptacle unit; the battery pack may be configured to be combined with the main body by inserting (instead of sliding) the battery pack into the receptacle unit; and/or the orientation of the handle may be designed differently.

Figure 15:
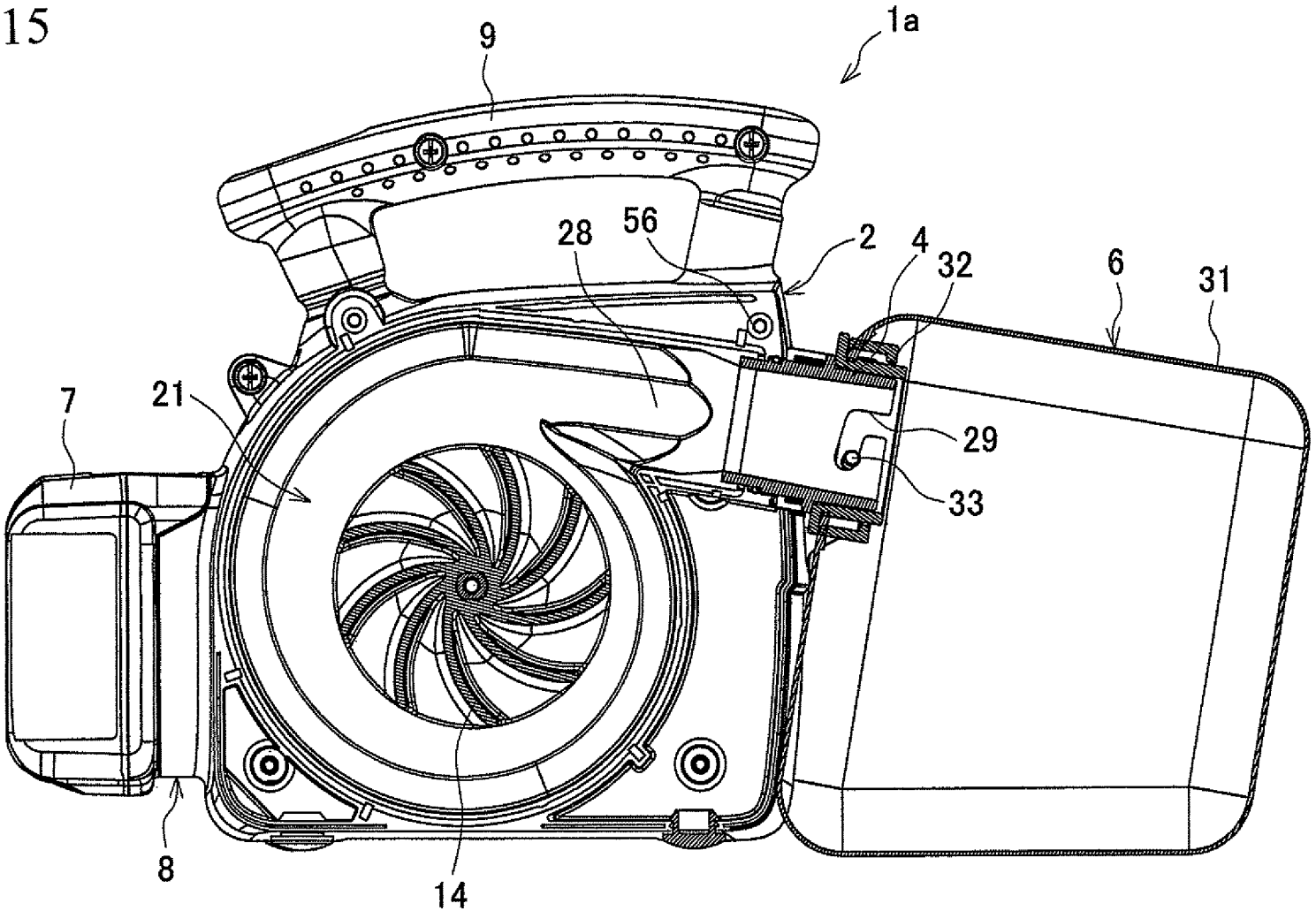
FIG. 15 is an explanatory diagram showing a section view of a dust collector for representing another embodiment of the present invention with a modified exhaust port.

Moreover, the exhaust port 4 of the main body 2 may be configured to orient downward, like a dust collector la as illustrated in FIG. 15. With this configuration, the backflow of the dust or the like within the exhaust port 4 can be prevented, so that dust can be collected more effectively into the dust bag 6. Also with this configuration, a screw boss 56 for fastening the fan cover 20 in a position above the exhaust port 4 can be designed not to protrude upward beyond the upper surface of the main body 2 as in the aforementioned embodiment, and thus an uncalled-for protrusion from the main body 2 can be reduced or removed so that the usability of the dust collector can be improved. Furthermore, when the dust collector is used as a blower, air blown therefrom is naturally oriented downward, and thus the usability of the dust collector as a blower can be improved.

Figure 16:
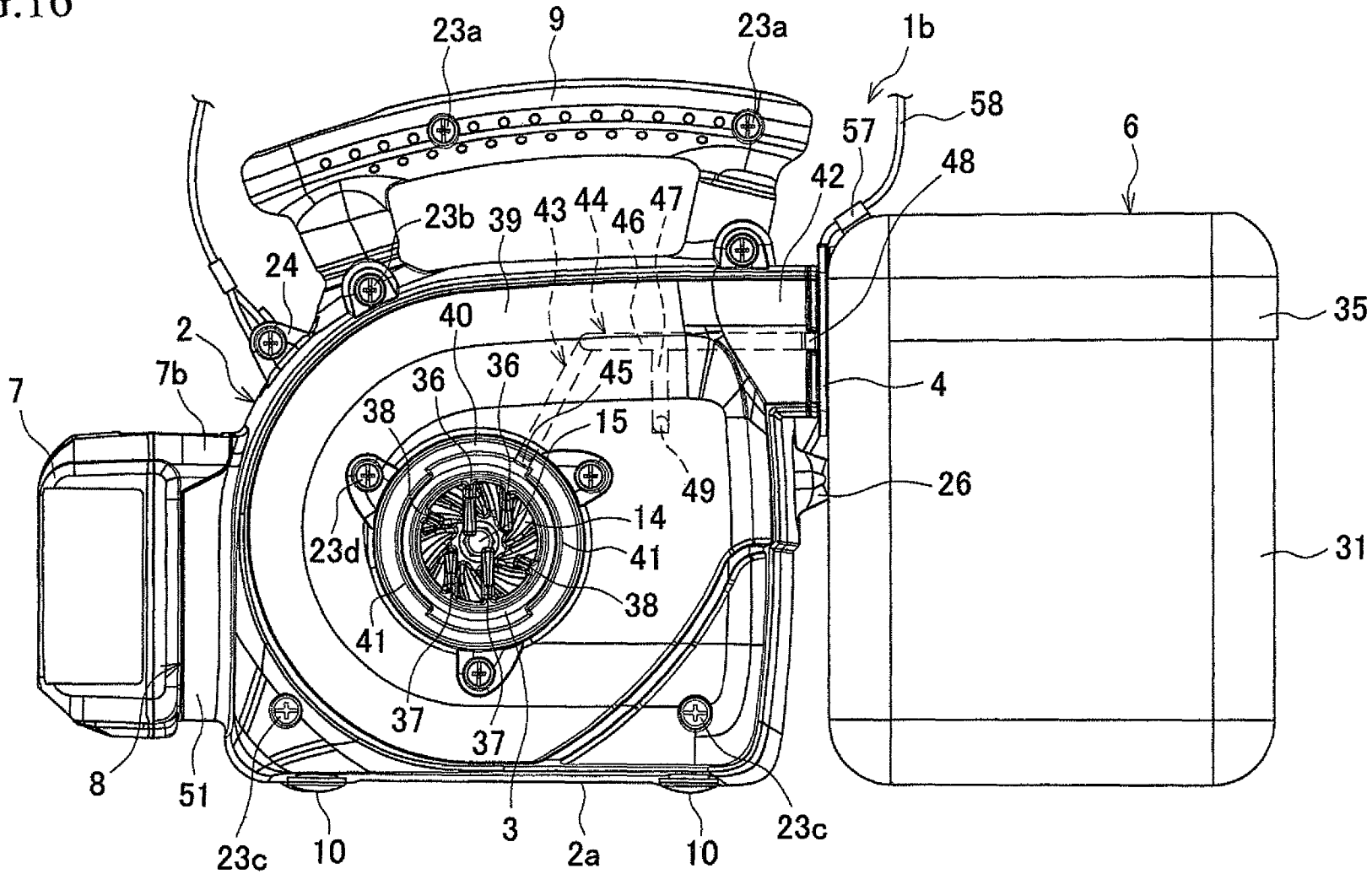
FIG. 16 is a front view of a dust collector according to yet another embodiment of the present invention.

Moreover, the dust bag 6 may be configured to include a belt loop 57 at an upper end on a main-body side of the dust bag 6 attached to the exhaust port 4, so that a belt 58 at the pin 27 side may be passed through this belt loop 57, like a dust collector 1*b* as illustrated in FIG. 16. With this configuration, when the main body 2 is carried with the belt 58, the weight of the dust bag, even if increased due to accumulated dust or the like, will be supported with the belt 58 pulling the dust bag 6 toward the main body 2 side so that the tendency of the dust bag 6 toward drooping low can be reduced. The belt loop 57 may be provided in a further outer position (farther away from the main body 2) on an upper side of the dust bag 6, and a plurality of belt loops 57 may be provided.

Figure 17A:
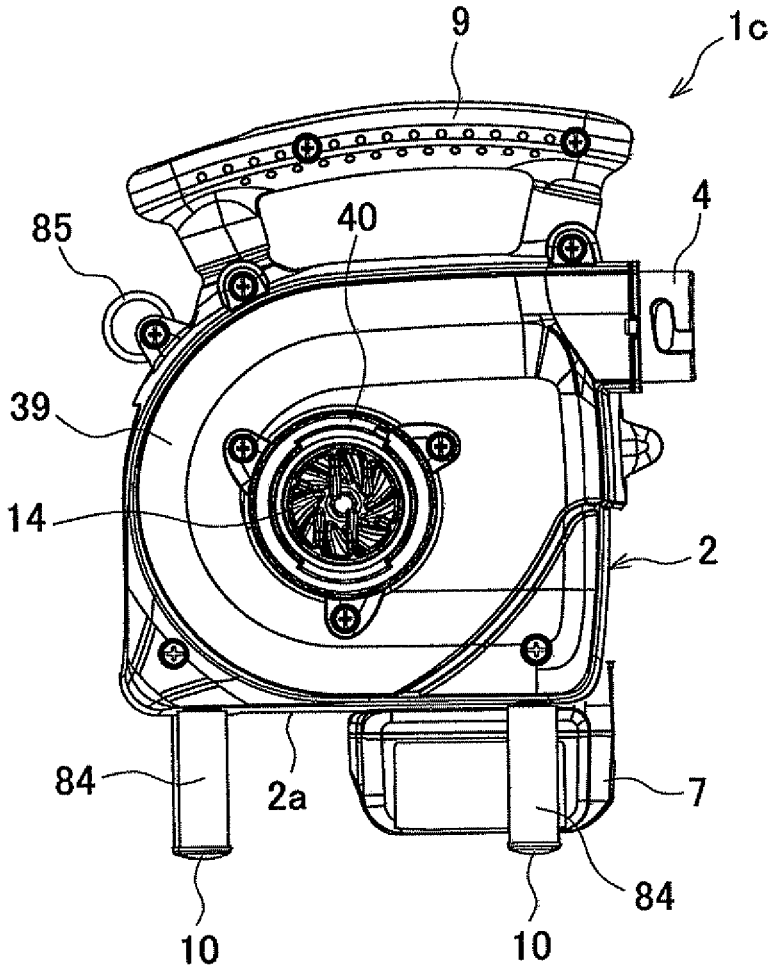
FIG. 17A is an explanatory diagram showing a front view of a dust collector according to yet another embodiment of the present invention.
Figure 17B:
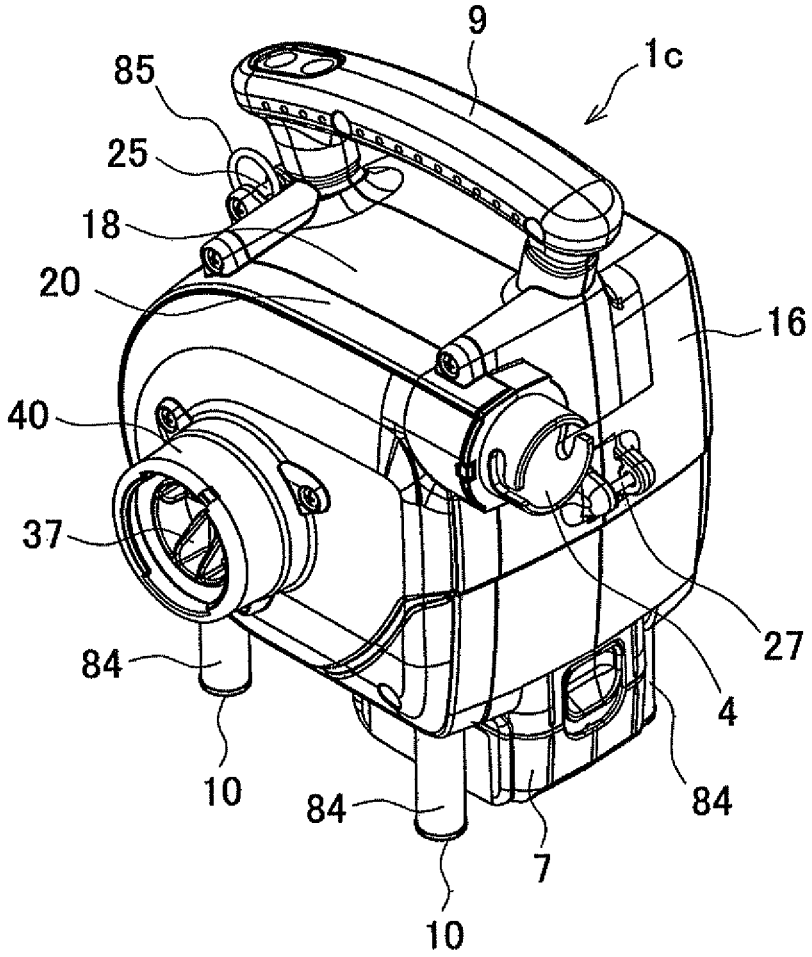
FIG. 17B is an explanatory diagram showing a perspective view of the dust collector of FIG. 17A.

The position of the receptacle unit for the battery pack to be attached thereto in the main body may not be limited to a position at the side of the main body, but may be a position at an underside of the main body; to be more specific, for example, the battery pack 7 may be installed at the underside of the main body 2, like a dust collector 1*c* as illustrated in FIG. 17. In this embodiment, the receptacle unit 8 is formed laterally at the combined sides the motor and fan housings 16, 18, and the battery pack 7 may be attached to the receptacle unit 8 across these housings 16, 18 at the underside of the main body 2 by sliding the battery pack 7 from the right side below the main body 2 toward leftward.

Denoted by 84 are legs provided at four corners of the supporting surface 2*a*, and a space in which the battery pack 7 can be installed is formed under the main body 2 with these legs 84.

Denoted by 85 is a ring which is loosely inserted around the boss 25 at the left side. The end portion of the belt may be fastened to the ring 85, and thus the belt passes along the side of the handle 9 so that the belt will become unlikely to interfere with the handle 9, and the handle 9 will be located in a position appropriate for an operator to grasp the handle 9 when the dust collector 1*c* is operated in the portable use mode.

With this configuration in which the battery pack 7 is attached to the underside of the main body 2 as described above, the position of the center of gravity of the dust collector 1*c* with the battery pack 7 attached becomes lower and thus the stability can be improved. Moreover, the dust collector 1*c* is designed to have the battery pack 7 provided without protruding to the front, rear, left and right, thus is compact in shape as viewed from above. This advantageously makes the operation of the dust collector 1*c* in the portable use mode and the carrying of the dust collector 1*c* easy and convenient.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

The invention claimed is:

1. A dust collector comprising:

a main body including a motor and a rotary fan to be driven by the motor;

an intake port provided at the main body to suck air therethrough from outside into the main body by rotation of the rotary fan;

an exhaust port provided at the main body to release the sucked air therethrough to the outside, and configured to allow a dust bag to be detachably attached thereto;

a receptacle unit provided at the main body and configured to allow a battery pack as a source of electric power to be attached thereto;

a handle provided at the main body and capable of being grasped;

a belt fastening part provided at the main body and configured to allow a belt to be fastened thereto; and a supporting surface provided at an underside of the main body and configured to allow the dust collector with the dust bag and the battery pack attached to the exhaust port and to the receptacle unit respectively to rest on a surface, wherein the main body includes a housing that is an assembly composed of at least two divisional housings, across which the battery pack attached to the receptacle unit is located.

2. The dust collector according to claim 1, wherein the handle is provided at an upper portion of the main body, and the exhaust port and the receptacle unit are provided at opposite sides of the main body whereby the battery pack attached to the receptacle unit and the dust bag attached to the exhaust port are located oppositely to laterally sandwich the main body as viewed from a front side of the main body.

3. The dust collector according to claim 2, wherein the handle is configured to extend laterally as viewed from the front side of the main body in a direction along which the dust bag attached to the exhaust port and the battery pack attached to the receptacle unit are arranged.

4. The dust collector according to claim 3, wherein the handle is configured to have a width and a thickness smaller than the width where the thickness is a dimension in an upward-downward direction and the width is a dimension in a front-rear direction.

5. The dust collector according to claim 1, wherein the receptacle unit is configured to allow the battery pack to be slid therealong from above the main body and thereby combined with the receptacle unit.

6. The dust collector according to claim 1, wherein the exhaust port is configured to orient downward.

7. The dust collector according to claim 1, wherein the dust bag includes a belt loop disposed at an upper end on a main-body side of the dust bag attached to the exhaust port.

8. The dust collector according to claim 1, wherein the handle is provided at an upper portion of the main body, and the exhaust port and the receptacle unit are provided at opposite sides of the main body whereby the battery pack attached to the receptacle unit and the dust bag attached to the exhaust port are located oppositely to laterally sandwich the main body as viewed from a front side of the main body.

9. The dust collector according to claim 8, wherein the handle is configured to extend laterally as viewed from the front side of the main body in a direction along which the dust bag attached to the exhaust port and the battery pack attached to the receptacle unit are arranged.

10. The dust collector according to claim 8, wherein the handle is configured to extend laterally as viewed from the front side of the main body in a direction along which the dust bag attached to the exhaust port and the battery pack attached to the receptacle unit are arranged; and wherein the handle is configured to have a width and a thickness smaller than the width where the thickness is a dimension in an upward-downward direction and the width is a dimension in a front-rear direction.

11. A dust collector comprising:

a main body including a motor and a rotary fan to be driven by the motor;

an intake port provided at the main body to suck air therethrough from outside into the main body by rotation of the rotary fan;

an exhaust port provided at the main body to release the sucked air therethrough to the outside, and configured to allow a dust bag to be detachably attached thereto;

a receptacle unit provided at the main body and configured to allow a battery pack as a source of electric power to be attached thereto;

a handle provided at the main body and capable of being grasped;

a belt fastening part provided at the main body and configured to allow a belt to be fastened thereto; and a supporting surface provided at an underside of the main body and configured to allow the dust collector with the dust bag and the battery pack attached to the exhaust port and to the receptacle unit respectively to rest on a surface, wherein a center of gravity of the battery pack attached to the receptacle unit is in a position lower than that of a center of gravity of the main body having no battery pack attached to the receptacle unit.

12. The dust collector according to claim 11, wherein the receptacle unit is disposed at the underside of the main body to allow the battery pack to be attached to the underside of the main body.

13. The dust collector according to 12, wherein legs are provided at corners of the supporting surface, and a space in which the battery pack attached to the receptacle unit is located is formed under the main body.

14. The dust collector according to claim 13, wherein caps each having a spherical surface at an underside thereof are provided at lower ends of the legs on the supporting surface.

15. A dust collector comprising:

a main body having a substantially flat underside and sides continuously extending to the underside;

an intake port arranged on a side of the main body;

an exhaust port arranged on a side of the main body and configured to allow a dust bag to be detachably attached thereto;

a receptacle unit arranged on a side of the main body and configured to allow a battery pack to be detachably attached thereto;

a handle arranged on an upper portion of the main body; and a belt capable of being attached to the main body, wherein the main body includes a housing that is an assembly composed of at least two divisional housings, across which the battery pack attached to the receptacle unit is located, and the underside is configured to be set in place on a floor.

16. A blower comprising:

a rotary fan to be driven by a motor, a housing composed of two divisional housings and accommodating the motor, an intake port formed in the two divisional housings, an exhaust port formed in a front part of the two divisional housings, a receptacle unit provided across the two divisional housings to allow a battery pack to be slid therealong from above the housings and capable to be attached thereto, a handle provided at the two divisional housings, wherein the handle is located above the middle of the housing and the receptacle unit is arranged behind the handle of the housing.

17. The blower according to claim 16, wherein the center of the battery pack and the center of the handle are in a same plane when the battery pack is attached to the receptacle unit.

18. The blower according to claim 16, wherein a front leg and a rear leg are disposed on an underside of the two divisional housings, and the rear leg is arranged in front of the receptacle unit.

19. The blower according to claim 16, wherein a front leg and a rear leg are disposed on an underside of the two divisional housings, and the motor is arranged between the front leg and the rear leg.

* * * * *